US010339913B2

(12) United States Patent
Maziewski et al.

(10) Patent No.: US 10,339,913 B2
(45) Date of Patent: Jul. 2, 2019

(54) CONTEXT-BASED CANCELLATION AND AMPLIFICATION OF ACOUSTICAL SIGNALS IN ACOUSTICAL ENVIRONMENTS

(71) Applicant: Intel Corporation, Santa Clara, CA (US)

(72) Inventors: Przemyslaw Maziewski, Gdansk (PL); Da-Ming Chiang, San Jose, CA (US); Shmuel Markovich Golan, Ramat Hasharon (IL); Swarnendu Kar, Portland, OR (US); Victoria Moore, Phoenix, AZ (US)

(73) Assignee: INTEL CORPORATION, Santa Clara, CA (US)

( * ) Notice: Subject to any disclaimer, the term of this patent is extended or adjusted under 35 U.S.C. 154(b) by 2 days.

(21) Appl. No.: 15/855,169

(22) Filed: Dec. 27, 2017

(65) Prior Publication Data

US 2019/0035381 A1 Jan. 31, 2019

(51) Int. Cl.

| | |
|---|---|
| ***G10L 25/51*** | (2013.01) |
| ***H04R 29/00*** | (2006.01) |
| ***G10K 11/178*** | (2006.01) |

(52) U.S. Cl.

CPC ..... *G10K 11/17827* (2018.01); *G10L 25/51* (2013.01); *H04R 29/001* (2013.01); *G10K 2210/3056* (2013.01); *H04R 2430/01* (2013.01)

(58) Field of Classification Search

CPC ..... H04R 1/08; H04R 2499/15; H04R 1/406; H04R 2225/43; H04R 2225/67; H04R 2499/13; H04R 25/353; H04R 25/505; H04R 3/005; H04R 5/02; H04R 5/04; H04M 1/72569; H04M 2242/04; H04M 2250/12; H04M 3/42059; H04M 3/42221; H04M 3/4878; H04M 3/5116;

(Continued)

(56) References Cited

U.S. PATENT DOCUMENTS

2001/0046304 A1* 11/2001 Rast ..... H04R 1/1041 381/74
2008/0130908 A1* 6/2008 Cohen ..... H04S 1/00 381/71.1

(Continued)

*Primary Examiner* — Lun-See Lao
(74) *Attorney, Agent, or Firm* — Jaffery, Watson, Mendonsa & Hamilton LLP

(57) ABSTRACT

A mechanism is described for facilitating context-based cancellation and amplification of acoustical signals in acoustical environments according to one embodiment. An apparatus of embodiments, as described herein, includes detection and recognition logic to detect an acoustical signal being emitted by an acoustical signal source; evaluation, estimation, and footprint logic to classify the acoustical signal as an emergency acoustical signal or a non-emergency acoustical signal, wherein the classification is based on a footprint or a footprint identification (ID) associated with the acoustical signal; acoustical signal cancellation logic to cancel the acoustical signal if the acoustical signal is regarded as the non-emergency acoustical signal based on the footprint or the footprint ID; and acoustical signal amplification logic to amplify the acoustical signal if the acoustical signal is classified as the emergency acoustical signal based on the footprint or the footprint ID.

20 Claims, 7 Drawing Sheets

(58) Field of Classification Search
CPC .. H04M 7/0057; H04S 3/008; H04S 2400/11; H04S 3/00; H04S 5/005; H04S 7/303; H03F 1/26; H03F 1/523; H03F 2200/271
USPC ..... 381/71.1–71.6, 55–58, 309; 700/94
See application file for complete search history.

(56) References Cited

U.S. PATENT DOCUMENTS

2014/0140552 A1* 5/2014 Hui ..... G08B 3/00
381/309
2014/0253326 A1* 9/2014 Cho ..... G08B 25/10
340/539.13

* cited by examiner

CONTEXT-BASED CANCELLATION AND AMPLIFICATION OF ACOUSTICAL SIGNALS IN ACOUSTICAL ENVIRONMENTS

FIELD

Embodiments described herein relate generally to data processing and more particularly to facilitate context-based cancellation and amplification of acoustical signals in acoustical environments.

BACKGROUND

Environmental acoustical signal can range from being simple nuisance to significantly harmful to human health. It is contemplated that not all forms of acoustical signals (e.g., noise) are equal, such as an acoustical signal (e.g., siren) from an emergency alarm would be regarded as far more important than the noise from the barking of neighborhood dogs. However, conventional noise-masking techniques are severely limited in their use and application as they are known for masking all forms and manners of acoustical signals and are not smart enough to distinguish between different acoustical signals based on their value, importance, and/or the like.

BRIEF DESCRIPTION OF THE DRAWINGS

Embodiments are illustrated by way of example, and not by way of limitation, in the figures of the accompanying drawings in which like reference numerals refer to similar elements.

DETAILED DESCRIPTION

Figure 1:
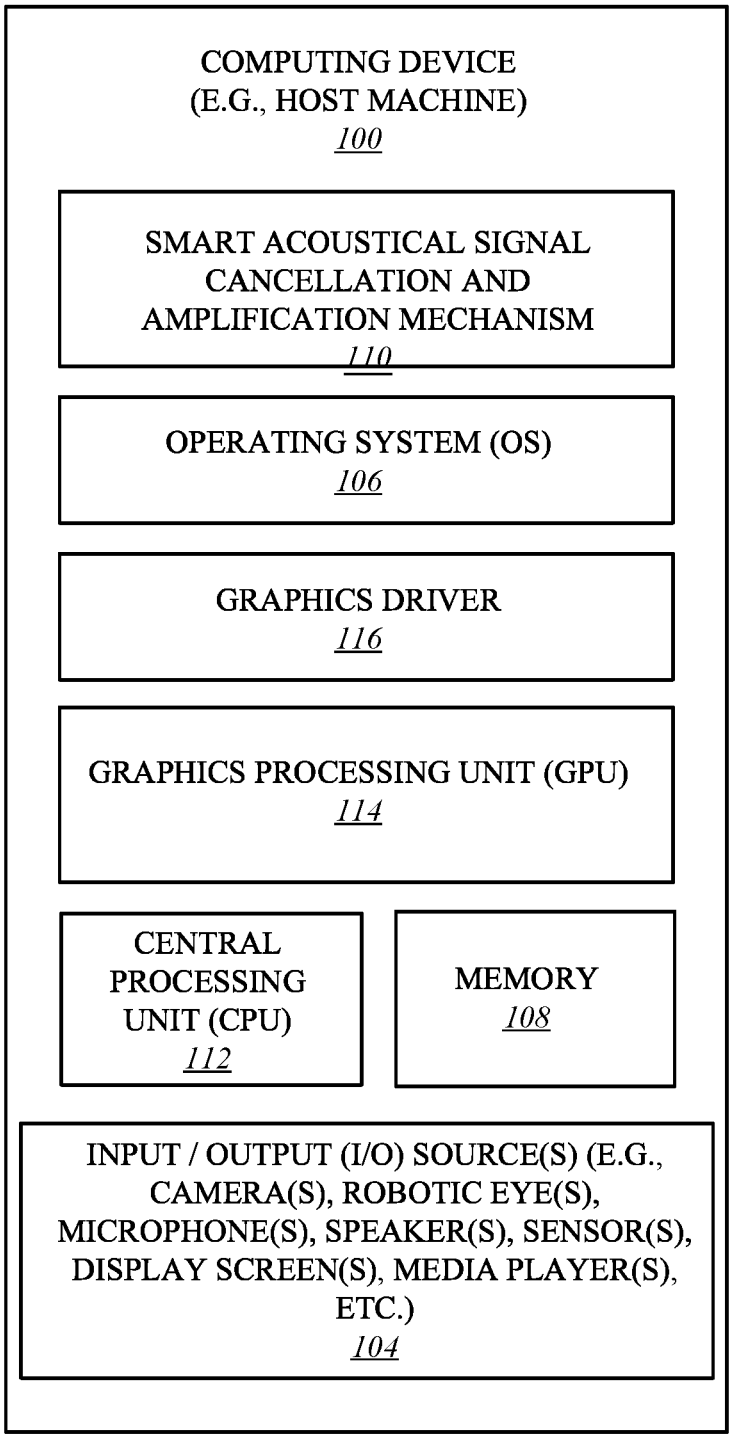
FIG. 1 illustrates a computing device hosting a smart acoustical signal cancellation and amplification mechanism according to one embodiment.

In the following description, numerous specific details are set forth. However, embodiments, as described herein, may be practiced without these specific details. In other instances, well-known circuits, structures and techniques have not been shown in detail in order not to obscure the understanding of this description.

Embodiments provide for a novel technique for intelligently attenuating or masking the unwanted environmental acoustical signals (e.g., noises, sounds, signals, sirens, etc.), while amplifying important acoustic signals. For example, cancelling certain noise based on the footprint of that noise generated by its noise source, masking noises with unknown footprint, and identifying and amplifying important acoustical signals.

It is contemplated and to be noted that embodiments are not limited to certain noises or sirens and that embodiments apply to all forms and levels of acoustical signals. It is further contemplated that terms are like "noise", "speech", "sound", "siren", "signal", and/or the like, are examples of acoustical signals and are therefore referenced interchangeably with the term "acoustical signal".

It is contemplated that terms like "request", "query", "job", "work", "work item", and "workload" may be referenced interchangeably throughout this document. Similarly, an "application" or "agent" may refer to or include a computer program, a software application, a game, a workstation application, etc., offered through an application programming interface (API), such as a free rendering API, such as Open Graphics Library (OpenGL®), DirectX® 11, DirectX® 12, etc., where "dispatch" may be interchangeably referred to as "work unit" or "draw" and similarly, "application" may be interchangeably referred to as "workflow" or simply "agent". For example, a workload, such as that of a three-dimensional (3D) game, may include and issue any number and type of "frames" where each frame may represent an image (e.g., sailboat, human face). Further, each frame may include and offer any number and type of work units, where each work unit may represent a part (e.g., mast of sailboat, forehead of human face) of the image (e.g., sailboat, human face) represented by its corresponding frame. However, for the sake of consistency, each item may be referenced by a single term (e.g., "dispatch", "agent", etc.) throughout this document.

In some embodiments, terms like "display screen" and "display surface" may be used interchangeably referring to the visible portion of a display device while the rest of the display device may be embedded into a computing device, such as a smartphone, a wearable device, etc. It is contemplated and to be noted that embodiments are not limited to any particular computing device, software application, hardware component, display device, display screen or surface, protocol, standard, etc. For example, embodiments may be applied to and used with any number and type of real-time applications on any number and type of computers, such as desktops, laptops, tablet computers, smartphones, head-mounted displays and other wearable devices, and/or the like. Further, for example, rendering scenarios for efficient performance using this novel technique may range from simple scenarios, such as desktop compositing, to complex scenarios, such as 3D games, augmented reality applications, etc.

It is to be noted that terms or acronyms like convolutional neural network (CNN), CNN, neural network (NN), NN, deep neural network (DNN), DNN, recurrent neural network (RNN), RNN, and/or the like, may be interchangeably referenced throughout this document. Further, terms like "autonomous machine" or simply "machine", "autonomous vehicle" or simply "vehicle", "autonomous agent" or simply "agent", "autonomous device" or "computing device", "robot", and/or the like, may be interchangeably referenced throughout this document.

FIG. 1 illustrates a computing device 100 employing a smart acoustical signal cancellation and amplification mechanism ("acoustics mechanism") 110 according to one embodiment. As an initial matter, as mentioned above, "noise" may be regarded as an example of acoustic signals and that it is interchangeably used with "acoustic signal" throughout this document and further that embodiments are applicable to all forms of acoustic signals, such as any type and level of sounds, speeches, signals, sirens, etc., and not merely limited to noise. Computing device 100 represents a communication and data processing device including or representing (without limitations) mobile devices (e.g., smartphones, tablet computers, etc.), gaming devices, handheld devices, wearable devices (e.g., smartwatches, smart bracelets, etc.), virtual reality (VR) devices, head-mounted display (HMDs), Internet of Things (IoT) devices, laptop computers, desktop computers, server computers, set-top boxes (e.g., Internet-based cable television set-top boxes, etc.), global positioning system (GPS)-based devices, etc. Computing device 100 may also include voice-enabled device (VEDs), voice command devices (VCDs), such as (without limitation) smart command devices or intelligent personal assistants (e.g., Echo® by Amazon.com®, etc.), home/office automation system, home appliances (e.g., washing machines, television sets, etc.).

In some embodiments, computing device 100 includes or works with or is embedded in or facilitates any number and type of other smart devices, such as (without limitation) autonomous machines or artificially intelligent agents, such as a mechanical agents or machines, electronics agents or machines, virtual agents or machines, electro-mechanical agents or machines, etc. Examples of autonomous machines or artificially intelligent agents may include (without limitation) robots, autonomous vehicles (e.g., self-driving cars, self-flying planes, self-sailing boats, etc.), autonomous equipment (self-operating construction vehicles, self-operating medical equipment, etc.), and/or the like. Further, "autonomous vehicles" are not limed to automobiles but that they may include any number and type of autonomous machines, such as robots, autonomous equipment, household autonomous devices, and/or the like, and any one or more tasks or operations relating to such autonomous machines may be interchangeably referenced with autonomous driving.

Further, for example, computing device 100 may include a computer platform hosting an integrated circuit ("IC"), such as a system on a chip ("SoC" or "SOC"), integrating various hardware and/or software components of computing device 100 on a single chip.

As illustrated, in one embodiment, computing device 100 may include any number and type of hardware and/or software components, such as (without limitation) graphics processing unit ("GPU" or simply "graphics processor") 114, graphics driver (also referred to as "GPU driver", "graphics driver logic", "driver logic", user-mode driver (UMD), UMD, user-mode driver framework (UMDF), UMDF, or simply "driver") 116, central processing unit ("CPU" or simply "application processor") 112, memory 108, network devices, drivers, or the like, as well as input/output (I/O) sources 104, such as touchscreens, touch panels, touch pads, virtual or regular keyboards, virtual or regular mice, ports, connectors, etc. Computing device 100 may include operating system (OS) 106 serving as an interface between hardware and/or physical resources of the computing device 100 and a user.

It is to be appreciated that a lesser or more equipped system than the example described above may be preferred for certain implementations. Therefore, the configuration of computing device 100 may vary from implementation to implementation depending upon numerous factors, such as price constraints, performance requirements, technological improvements, or other circumstances.

Embodiments may be implemented as any or a combination of: one or more microchips or integrated circuits interconnected using a parentboard, hardwired logic, software stored by a memory device and executed by a microprocessor, firmware, an application specific integrated circuit (ASIC), and/or a field programmable gate array (FPGA). The terms "logic", "module", "component", "engine", and "mechanism" may include, by way of example, software or hardware and/or a combination thereof, such as firmware.

In one embodiment, as illustrated, acoustics mechanism 110 may be hosted by operating system 106 in communication with I/O source(s) 104, such as microphone(s), of computing device 100. In another embodiment, acoustics mechanism 110 may be hosted or facilitated by graphics driver 116. In yet another embodiment, acoustics mechanism 110 may be hosted by or part of graphics processing unit ("GPU" or simply graphics processor") 114 or firmware of graphics processor 114. For example, acoustics mechanism 110 may be embedded in or implemented as part of the processing hardware of graphics processor 114. Similarly, in yet another embodiment, acoustics mechanism 110 may be hosted by or part of central processing unit ("CPU" or simply "application processor") 112. For example, acoustics mechanism 110 may be embedded in or implemented as part of the processing hardware of application processor 112.

In yet another embodiment, acoustics mechanism 110 may be hosted by or part of any number and type of components of computing device 100, such as a portion of acoustics mechanism 110 may be hosted by or part of operating system 116, another portion may be hosted by or part of graphics processor 114, another portion may be hosted by or part of application processor 112, while one or more portions of acoustics mechanism 110 may be hosted by or part of operating system 116 and/or any number and type of devices of computing device 1500. It is contemplated that embodiments are not limited to any implementation or hosting of acoustics mechanism 110 and that one or more portions or components of acoustics mechanism 110 may be employed or implemented as hardware, software, or any combination thereof, such as firmware.

Computing device 100 may host network interface(s) to provide access to a network, such as a LAN, a wide area network (WAN), a metropolitan area network (MAN), a personal area network (PAN), Bluetooth, a cloud network, a mobile network (e.g., $3^{rd}$ Generation (3G), $4^{th}$ Generation (4G), etc.), an intranet, the Internet, etc. Network interface(s) may include, for example, a wireless network interface having antenna, which may represent one or more antenna(e). Network interface(s) may also include, for example, a wired network interface to communicate with remote devices via network cable, which may be, for example, an Ethernet cable, a coaxial cable, a fiber optic cable, a serial cable, or a parallel cable.

Embodiments may be provided, for example, as a computer program product which may include one or more machine-readable media having stored thereon machine-executable instructions that, when executed by one or more machines such as a computer, network of computers, or other electronic devices, may result in the one or more machines carrying out operations in accordance with embodiments described herein. A machine-readable medium may include, but is not limited to, floppy diskettes, optical disks, CD-ROMs (Compact Disc-Read Only Memories), and magneto-optical disks, ROMs, RAMs, EPROMs (Erasable Programmable Read Only Memories), EEPROMs (Electrically Erasable Programmable Read Only Memories), magnetic or optical cards, flash memory, or other type of media/machine-readable medium suitable for storing machine-executable instructions.

Moreover, embodiments may be downloaded as a computer program product, wherein the program may be transferred from a remote computer (e.g., a server) to a requesting computer (e.g., a client) by way of one or more data signals embodied in and/or modulated by a carrier wave or other propagation medium via a communication link (e.g., a modem and/or network connection).

Throughout the document, term "user" may be interchangeably referred to as "viewer", "observer", "speaker", "person", "individual", "end-user", and/or the like. It is to be noted that throughout this document, terms like "graphics domain" may be referenced interchangeably with "graphics processing unit", "graphics processor", or simply "GPU" and similarly, "CPU domain" or "host domain" may be referenced interchangeably with "computer processing unit", "application processor", or simply "CPU".

It is to be noted that terms like "node", "computing node", "server", "server device", "cloud computer", "cloud server", "cloud server computer", "machine", "host machine", "device", "computing device", "computer", "computing system", and the like, may be used interchangeably throughout this document. It is to be further noted that terms like "application", "software application", "program", "software program", "package", "software package", and the like, may be used interchangeably throughout this document. Also, terms like "job", "input", "request", "message", and the like, may be used interchangeably throughout this document.

Figure 2:
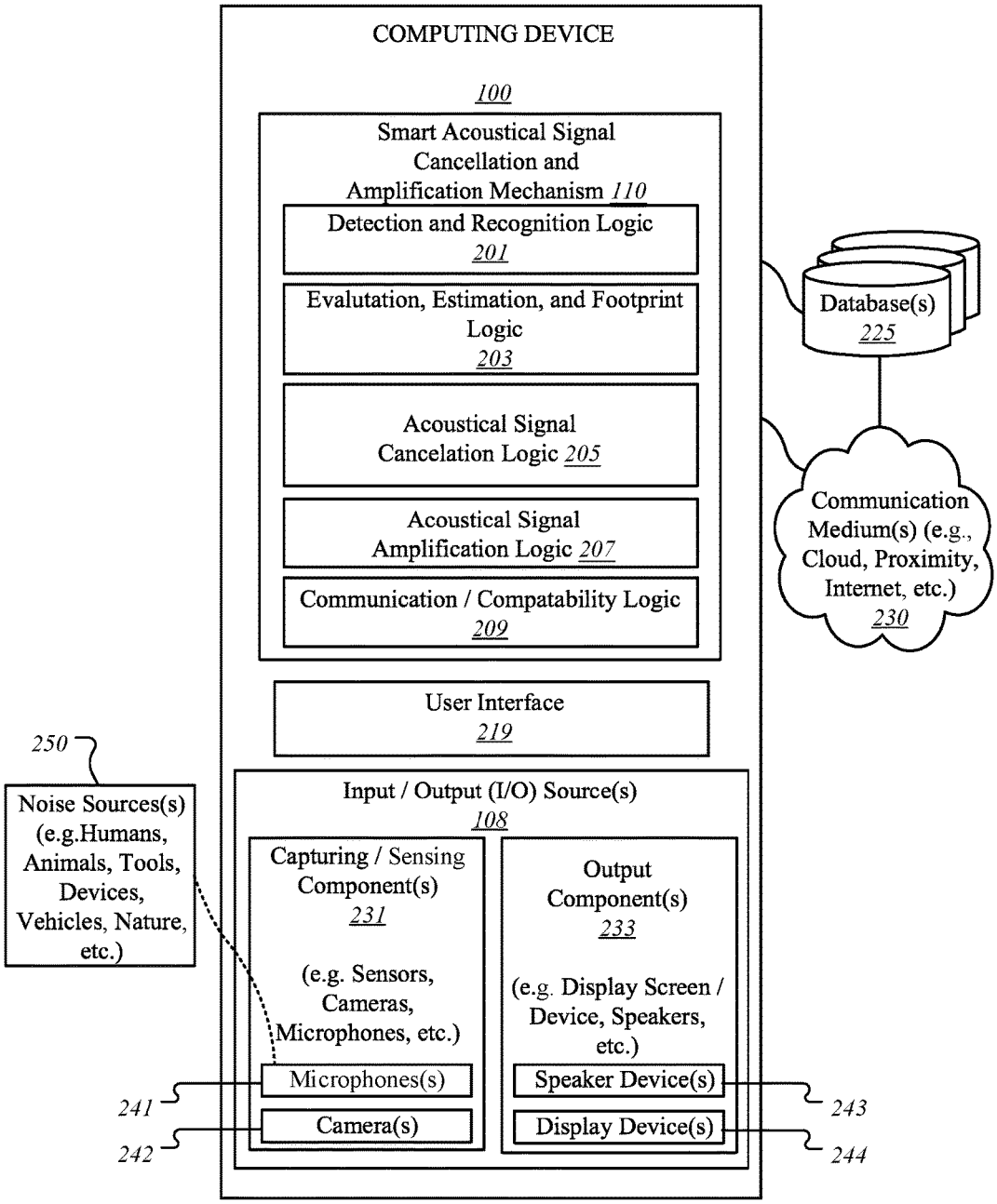
FIG. 2 illustrates the smart acoustical signal cancellation and amplification mechanism of FIG. 1 according to one embodiment.

FIG. 2 illustrates smart acoustical signal cancellation and amplification mechanism 110 of FIG. 1 according to one embodiment. For brevity, many of the details already discussed with reference to FIG. 1 are not repeated or discussed hereafter. In one embodiment, acoustics mechanism 110 may include any number and type of components, such as (without limitations): detection and recognition logic 201; evaluation, estimation, and footprint logic 203; acoustical signal cancellation logic 205; acoustical signal amplification logic 207; and communication/compatibility logic 209.

Computing device 100 is further shown to include user interface 219 (e.g., graphical user interface (GUI)-based user interface, Web browser, cloud-based platform user interface, software application-based user interface, other user or application programming interfaces (APIs), etc.). Computing device 100 may further include I/O source(s) 108 having capturing/sensing component(s) 231, such as camera(s) 242 (e.g., Intel® RealSense™ camera), sensors, microphone(s) 241, etc., and output component(s) 233, such as display device(s) 244 or simply display(s) (e.g., integral displays, tensor displays, projection screens, display screens, etc.), speaker devices(s) or simply speaker(s) 243, etc.

Computing device 100 is further illustrated as having access to and/or being in communication with one or more database(s) 225 and/or one or more of other computing devices over one or more communication medium(s) 230 (e.g., networks such as a cloud network, a proximity network, the Internet, etc.).

In some embodiments, database(s) 225 may include one or more of storage mediums or devices, repositories, data sources, etc., having any amount and type of information, such as data, metadata, etc., relating to any number and type of applications, such as data and/or metadata relating to one or more users, physical locations or areas, applicable laws, policies and/or regulations, user preferences and/or profiles, security and/or authentication data, historical and/or preferred details, and/or the like.

As aforementioned, computing device 100 may host I/O sources 108 including capturing/sensing component(s) 231 and output component(s) 233. In one embodiment, capturing/sensing component(s) 231 may include a sensor array including, but not limited to, microphone(s) 241 (e.g., ultrasound microphones), camera(s) 242 (e.g., two-dimensional (2D) cameras, three-dimensional (3D) cameras, infrared (IR) cameras, depth-sensing cameras, etc.), capacitors, radio components, radar components, scanners, and/or accelerometers, etc. Similarly, output component(s) 233 may include any number and type of display devices or screens, projectors, speakers, light-emitting diodes (LEDs), speaker(s) 243, and/or vibration motors, etc.

For example, as illustrated, capturing/sensing component(s) 231 may include any number and type of microphones(s) 241, such as multiple microphones or a microphone array, such as ultrasound microphones, dynamic microphones, fiber optic microphones, laser microphones, etc. It is contemplated that one or more of microphone(s) 241 serve as one or more input devices for accepting or receiving audio inputs (such as human voice) into computing device 100 and converting this audio or sound into electrical signals. Similarly, it is contemplated that one or more of camera(s) 242 serve as one or more input devices for detecting and capturing of image and/or videos of scenes, objects, etc., and provide the captured data as video inputs into computing device 100.

It is contemplated that embodiments are not limited to any number or type of microphone(s) 241, camera(s) 243, speaker(s) 243, display(s) 244, etc. For example, as facilitated by detection and recognition logic 201, one or more of microphone(s) 241 may be used to detect acoustic signals, such as speech, sound, noise, siren, etc., from one or more acoustical signal sources 250 (also referred to as "acoustic signal sources", "noise or signal makers", "noise or signal emitters", etc.), such as humans, animals, tools, devices, vehicles, nature, and/or the like, as further displayed with reference to FIG. 3A. For brevity and clarity, acoustic signals, such as speech, sounds, sirens, noise, etc., may be collectively or interchangeably referred to as "noise" throughout this document.

Similarly, as illustrated, output component(s) 233 may include any number and type of speaker device(s) or speaker(s) 243 to serve as output devices for outputting or giving out audio from computing device 100 for any number or type of reasons, such as human hearing or consumption. For example, speaker(s) 243 work the opposite of microphone(s) 241 where speaker(s) 243 convert electric signals into sound. Similarly, output component(s) 233 may include display device(s) or display(s) 244 to present visual images or video streams, etc.

As aforementioned, acoustic signal pollution from environmental acoustic signals or noises can have a great deal of negative effect on human health and psychology, ranging from simple nuisance or annoyance to loss of hearing and other serious health consequences. Although several attempts have been made to mask the acoustic signals, such attempts are severely limited in their approach and application as they are not intelligent enough to distinguish between wanted and unwanted noise, important and unimportant sounds, warnings and mere annoyance, and/or the like.

For example, as is further described with reference to FIG. 3A, to a common individual, the sound of a jackhammer would be rather unimportant when compared to the sound of the individual's crying baby. In other words, depending on the nature of acoustical signal source(s) 250 and their relevance to the listener, the emitted acoustic signals may or may not be of any worth to the individual. For example, when acoustical signal source(s) 250 is a baby or a dog, the crying sound of the baby or the barking noise of the dog may be of greater value to the listening individual if the baby or the dog is their own.

Similarly, for example, acoustical signal source(s) 250 being an emergency vehicle or sound maker, such as an ambulance carrying a patient, a fire engine heading to the fire, a mobile device sounding an amber alert, etc., may be equally important and of value to all listeners as such manners or types of acoustic signals are regarded as public announcements for general good of the public.

Embodiments provide for a novel technique for recognizing and cancelling unimportant acoustic signals, while evaluating and amplifying important acoustic signals. Embodiments further provide for the application and use of footprints with certain acoustic signals to better evaluate each acoustic signal and use this evaluation in decision making as to whether certain acoustic signal is to be cancelled, masked, reduced, or amplified. For example, cancelling a noise (jackhammer noise) based on its footprint as generated by a corresponding acoustical signal source(s) 250 (e.g., jackhammer), identifying and amplifying important acoustical signals (e.g., emergency signal) being emitted by a corresponding acoustical signal source(s) 250 (e.g., ambulance), and masking acoustic signals with unknown or missing footprint (e.g., dog bark) being emitted by a corresponding acoustical signal source(s) 250 (e.g., dog), and/or the like.

Referring back to acoustics mechanism 110, once an acoustic signal is detected and recognized by detection and recognition logic 201, it may then be evaluated by evaluation, estimation, and footprint logic 203 for one or more of footprints associated with the acoustic signal, nature of the acoustic signal, acoustical signal source(s) 250 of the acoustic signal, etc. A footprint refers to a measure identification associated with an acoustic signal, where using the acoustic signal can be easily identified using the footprint. For example, certain acoustic signals are regarded as well-known and/or consistent in terms of one or more of their form, frequency, pitch, etc., and thus, such acoustic signals may be assigned footprints that can then be used to identify such acoustic signals as facilitated by evaluation, estimation, and footprint logic 203.

As will be further discussed later in document, in one embodiment, any identification about an acoustic signal revealed by a footprint may then be used by evaluation, estimation, and footprint logic 203 to further evaluate the acoustic signal to determine the type of the acoustic signal, one or more acoustical signal source(s) 250 of the acoustic signal, and whether the acoustic signal by masked, reduced, or cancelled by acoustical signal cancellation logic 205 or increased or amplified by acoustical signal amplification logic 207.

For example, once an acoustic signal having assigned a footprint is generated and emitted by its corresponding acoustical signal source(s) 250, the acoustic signal may then be detected and recognized by detection and recognition logic 201, which is then followed by detection and evaluation of the footprint by evaluation, estimation, and footprint logic 203 to identify noisy components of the acoustic signal. If, for example, the footprint reveals the acoustic signal to be nuisance, unimportant, etc. (e.g., jackhammer noise, etc.), acoustical signal cancellation logic 205 may then be triggered to cancel or mask the identified noisy components from the acoustic signal being emitted by acoustical signal source(s) 250. Similarly, if the footprint reveals the acoustic signal to be important, urgent, etc., (e.g., ambulance signal, etc.) then acoustical signal amplification logic 207 may be triggered to increase or amplify the acoustic signal so that it may be heard by the relevant individuals.

Embodiments also provide for cancellation and/or amplification of acoustic signals that are not assigned (or are incapable of being assigned) footprints. For example, although not assigned footprints, certain acoustic signals, such as baby crying, dogs barking, burglar alarms, etc., may be assigned pre-defined importance acoustic signals ("importance signals") which may then be evaluated by evaluation, estimation, and footprint logic 203. Upon evaluation, if the importance signal indicates high importance of an acoustic signal (e.g., burglar alarm), then the acoustic signal is amplified as facilitated by acoustical signal amplification logic 207. Similarly, if the importance signal indicates low importance of an acoustic signal (e.g., dog bark), then the noise may be cancelled as facilitated by acoustical signal cancellation logic 205.

In some embodiments, acoustic signal may be measured for its annoyance as facilitated by evaluation, estimation, and footprint logic 203. For example, when neither the footprint is assigned to nor the importance signal is known of an acoustic signal (e.g., dog barking), evaluation, estimation, and footprint logic 203 may then estimate the annoyance level of the acoustic signal is determined to be high, the acoustic signal may then be cancelled or significantly reduced or mitigated by masking the noisy components of the acoustical signal as facilitated by acoustical signal cancellation logic 205. If, however, the annoyance level of the acoustic signal is found to be low or insignificant, the acoustic signal may then be left unchanged.

Figure 3A:
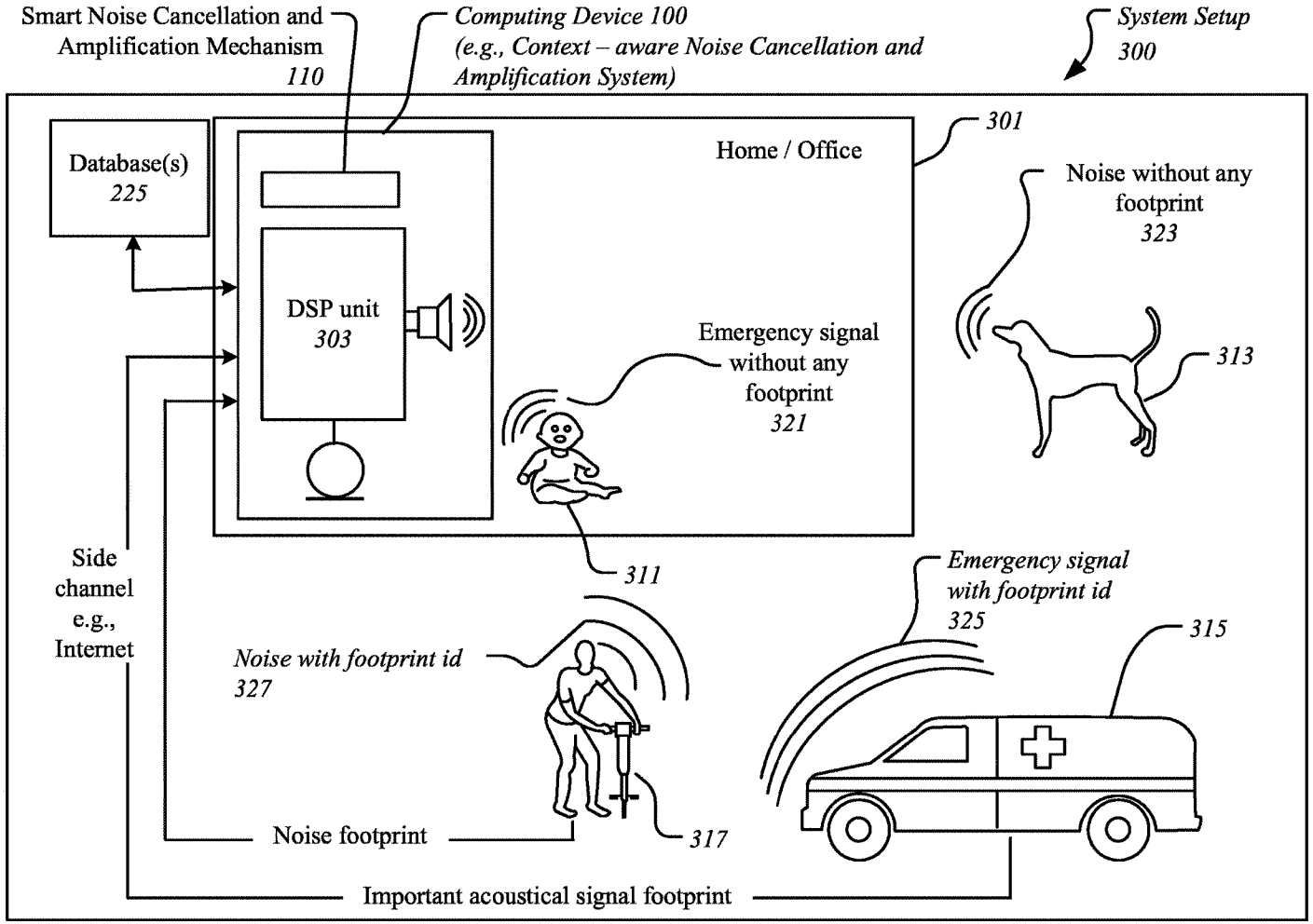
FIG. 3A illustrates a system setup showing a use case scenario for acoustical signal cancellation and amplification according to one embodiment.

As further illustrated in reference to FIG. 3A, relatively known and consistent form of acoustic signals, such as jackhammer or tool noises, ambulance or other emergency sirens, alarm clock or mobile phone alarms, airplane or other motor engine sounds, etc., may be assigned footprints that may reveal identification and other similar attributes about such acoustic signals. In contrast, relatively unknown or inconsistent form of acoustic signals, such as babies or children crying, people talking or screaming, dogs barking or other animals making noise, rain falling or thundering, waves hitting rocks or water falls, etc., and thus such acoustic signals may not be assigned footprint.

In one embodiment, a footprint may be assigned to an acoustic signal at the time of manufacturing of its acoustical signal source(s) 250, such as the manufacturer of an alarm clock may assign a footprint to the noise of alarm from that alarm clock, etc. In another embodiment, footprints may be assigned in real-time by evaluation, estimation, and footprint logic 203. For example, certain acoustic signals in the vicinity of computing device 100 may be continuously observed and evaluated by evaluation, estimation, and footprint logic 203 and upon having sufficient history and attributes relating to the acoustic signal, when the same acoustic signal is detected and/or recognized again by detection and recognition logic 201, that acoustic signal may then be evaluated and assigned a footprint by evaluation, estimation, and footprint logic 203.

In one embodiment, any footprints may be stored and maintained at one or more database(s) 225 accessible to evaluation, estimation, and footprint logic 203 through communication/compatibility logic 209 over one or more communication medium(s), such as a cloud network, a proximity network, the Internet, etc. For example, if a footprint is previously assigned to an acoustic signal, such as at the time of manufacturing, that footprint already be stored at and available for access from one or more of database(s) 225. Similarly, if a footprint is assigned to an acoustic signal is real-time, such as by evaluation, estimation, and footprint logic 203, upon assigning the footprint, evaluation, estimation, and footprint logic 203 may direct the footprint to be stored at one or more of database(s) 225 over one or more communication medium(s) 230. In some embodiment, as with footprints, importance signals may also be stored and maintained at one or more database(s) 225 and accessible to evaluation, estimation, and footprint logic 203 over one or more communication medium(s) 230.

Further, in one embodiment, detection and recognition logic 201 may be used to monitor acoustical environments associated various acoustical signal source(s) 250 in detecting any one or more of acoustical signal source(s) 250 that might be generating high sound pressure levels (SPLs). If such an acoustical signal source of acoustical signal source(s) 250 is discovered, assuming the acoustic signal being emitted by the discovered acoustical signal source has a footprint, communication/compatibility logic 209 may then be triggered to report back to the noise source the findings of detection and recognition logic 201 and request the acoustical signal source and/or its operator to limit the acoustic signal. For example, if the device of acoustical signal source(s) 250 making the acoustic signal is smart, such as a smart device, a smart vehicle, etc., then the message may be communicated directly to the device, and/or to the person operating the device, such as to the mobile device of the person. In some embodiments, communication/compatibility logic 209 may be used to report the incident to proper individuals or even legal authorities, such as in case of open-air music concerts, late-night or early-hour construction, late-hour neighborhood parties with loud music or chatter, etc.

Capturing/sensing component(s) 231 may further include any number and type of cameras, such as depth-sensing cameras or capturing devices (e.g., Intel® RealSense™ depth-sensing camera) that are known for capturing still and/or video red-green-blue (RGB) and/or RGB-depth (RGB-D) images for media, such as personal media. Such images, having depth information, have been effectively used for various computer vision and computational photography effects, such as (without limitations) scene understanding, refocusing, composition, cinema-graphs, etc. Similarly, for example, displays may include any number and type of displays, such as integral displays, tensor displays, stereoscopic displays, etc., including (but not limited to) embedded or connected display screens, display devices, projectors, etc.

Capturing/sensing component(s) 231 may further include one or more of vibration components, tactile components, conductance elements, biometric sensors, chemical detectors, signal detectors, electroencephalography, functional near-infrared spectroscopy, wave detectors, force sensors (e.g., accelerometers), illuminators, eye-tracking or gaze-tracking system, head-tracking system, etc., that may be used for capturing any amount and type of visual data, such as images (e.g., photos, videos, movies, audio/video streams, etc.), and non-visual data, such as audio streams or signals (e.g., sound, noise, vibration, ultrasound, etc.), radio waves (e.g., wireless signals, such as wireless signals having data, metadata, signs, etc.), chemical changes or properties (e.g., humidity, body temperature, etc.), biometric readings (e.g., figure prints, etc.), brainwaves, brain circulation, environmental/weather conditions, maps, etc. It is contemplated that "sensor" and "detector" may be referenced interchangeably throughout this document. It is further contemplated that one or more capturing/sensing component(s) 231 may further include one or more of supporting or supplemental devices for capturing and/or sensing of data, such as illuminators (e.g., IR illuminator), light fixtures, generators, sound blockers, etc.

It is further contemplated that in one embodiment, capturing/sensing component(s) 231 may further include any number and type of context sensors (e.g., linear accelerometer) for sensing or detecting any number and type of contexts (e.g., estimating horizon, linear acceleration, etc., relating to a mobile computing device, etc.). For example, capturing/sensing component(s) 231 may include any number and type of sensors, such as (without limitations): accelerometers (e.g., linear accelerometer to measure linear acceleration, etc.); inertial devices (e.g., inertial accelerometers, inertial gyroscopes, micro-electro-mechanical systems (MEMS) gyroscopes, inertial navigators, etc.); and gravity gradiometers to study and measure variations in gravitation acceleration due to gravity, etc.

Further, for example, capturing/sensing component(s) 231 may include (without limitations): audio/visual devices (e.g., cameras, microphones, speakers, etc.); context-aware sensors (e.g., temperature sensors, facial expression and feature measurement sensors working with one or more cameras of audio/visual devices, environment sensors (such as to sense background colors, lights, etc.); biometric sensors (such as to detect fingerprints, etc.), calendar maintenance and reading device), etc.; global positioning system (GPS) sensors; resource requestor; and/or TEE logic. TEE logic may be employed separately or be part of resource requestor and/or an I/O subsystem, etc. Capturing/sensing component(s) 231 may further include voice recognition devices, photo recognition devices, facial and other body recognition components, voice-to-text conversion components, etc.

Similarly, output component(s) 233 may include dynamic tactile touch screens having tactile effectors as an example of presenting visualization of touch, where an embodiment of such may be ultrasonic generators that can send signals in space which, when reaching, for example, human fingers can cause tactile sensation or like feeling on the fingers. Further, for example and in one embodiment, output component(s) 233 may include (without limitation) one or more of light sources, display devices and/or screens, audio speakers, tactile components, conductance elements, bone conducting speakers, olfactory or smell visual and/or non/visual presentation devices, haptic or touch visual and/or non-visual presentation devices, animation display devices, biometric display devices, X-ray display devices, high-resolution displays, high-dynamic range displays, multi-view displays, and head-mounted displays (HMDs) for at least one of virtual reality (VR) and augmented reality (AR), etc.

It is contemplated that embodiment are not limited to any particular number or type of use-case scenarios, architectural placements, or component setups; however, for the sake of brevity and clarity, illustrations and descriptions are offered and discussed throughout this document for exemplary purposes but that embodiments are not limited as such. Further, throughout this document, "user" may refer to someone having access to one or more computing devices, such as computing device 100, and may be referenced interchangeably with "person", "individual", "human", "him", "her", "child", "adult", "viewer", "player", "gamer", "developer", programmer", and/or the like.

Communication/compatibility logic 209 may be used to facilitate dynamic communication and compatibility between various components, networks, computing devices, database(s) 225, and/or communication medium(s) 230, etc., and any number and type of other computing devices (such as wearable computing devices, mobile computing devices, desktop computers, server computing devices, etc.), processing devices (e.g., central processing unit (CPU), graphics processing unit (GPU), etc.), capturing/sensing components (e.g., non-visual data sensors/detectors, such as audio sensors, olfactory sensors, haptic sensors, signal sensors, vibration sensors, chemicals detectors, radio wave detectors, force sensors, weather/temperature sensors, body/biometric sensors, scanners, etc., and visual data sensors/detectors, such as cameras, etc.), user/context-awareness components and/or identification/verification sensors/devices (such as biometric sensors/detectors, scanners, etc.), memory or storage devices, data sources, and/or database(s) (such as data storage devices, hard drives, solid-state drives, hard disks, memory cards or devices, memory circuits, etc.), network(s) (e.g., Cloud network, Internet, Internet of Things, intranet, cellular network, proximity networks, such as Bluetooth, Bluetooth low energy (BLE), Bluetooth Smart, Wi-Fi proximity, Radio Frequency Identification, Near Field Communication, Body Area Network, etc.), wireless or wired communications and relevant protocols (e.g., Wi-Fi®, WiMAX, Ethernet, etc.), connectivity and location management techniques, software applications/websites, (e.g., social and/or business networking websites, business applications, games and other entertainment applications, etc.), programming languages, etc., while ensuring compatibility with changing technologies, parameters, protocols, standards, etc.

Throughout this document, terms like "logic", "component", "module", "framework", "engine", "tool", "circuitry", and/or the like, may be referenced interchangeably and include, by way of example, software, hardware, and/or any combination of software and hardware, such as firmware. In one example, "logic" may refer to or include a software component that is capable of working with one or more of an operating system, a graphics driver, etc., of a computing device, such as computing device 100. In another example, "logic" may refer to or include a hardware component that is capable of being physically installed along with or as part of one or more system hardware elements, such as an application processor, a graphics processor, etc., of a computing device, such as computing device 100. In yet another embodiment, "logic" may refer to or include a firmware component that is capable of being part of system firmware, such as firmware of an application processor or a graphics processor, etc., of a computing device, such as computing device 100.

Further, any use of a particular brand, word, term, phrase, name, and/or acronym, such as "acoustic signal", "acoustic signal source", "noise", "noise source", "signal", "sound", "speech", "siren", "footprint", "importance signal", "annoyance", "nuisance", "cancellation", "masking", "mitigation", "amplification", "increase", "RealSense™ camera", "real-time", "automatic", "dynamic", "user interface", "camera", "sensor", "microphone", "display screen", "speaker", "verification", "authentication", "privacy", "user", "user profile", "user preference", "sender", "receiver", "personal device", "smart device", "mobile computer", "wearable device", "IoT device", "proximity network", "cloud network", "server computer", etc., should not be read to limit embodiments to software or devices that carry that label in products or in literature external to this document.

It is contemplated that any number and type of components may be added to and/or removed from acoustics mechanism 110 to facilitate various embodiments including adding, removing, and/or enhancing certain features. For brevity, clarity, and ease of understanding of acoustics mechanism 110, many of the standard and/or known components, such as those of a computing device, are not shown or discussed here. It is contemplated that embodiments, as described herein, are not limited to any technology, topology, system, architecture, and/or standard and are dynamic enough to adopt and adapt to any future changes.

FIG. 3A illustrates a system setup 300 showing a use case scenario for acoustic signal cancellation and amplification according to one embodiment. For brevity, many of the details previously discussed with reference to FIGS. 1-2 may not be discussed or repeated hereafter. Any processes or transactions may be performed by processing logic that may comprise hardware (e.g., circuitry, dedicated logic, programmable logic, etc.), software (such as instructions run on a processing device), or a combination thereof, as facilitated by acoustics mechanism 110 of FIG. 1. Any processes or transactions associated with this illustration may be illustrated or recited in linear sequences for brevity and clarity in presentation; however, it is contemplated that any number of them can be performed in parallel, asynchronously, or in different orders.

The illustrated embodiment discloses two types of acoustical signals (e.g., noises, signals, sirens, etc.): 1) ones with footprints, such as jackhammer/pneumatic hammer noise 327 and ambulance signal 325; and 2) those without any footprints, such as baby crying noise 321 and dog barking noise 323. Before proceeding with further discussion, it is contemplated and to be noted that embodiments are not limited to this illustration or any of its components, participants, acoustical signals, etc., and that illustration is provided to highlight the novel technique, as facilitated by acoustics mechanism 110, with brevity, clarity, and ease of understanding.

Referring back to system setup 300, as previously discussed, a footprint may contain certain acoustic properties, such as location and other characteristics (e.g., physical model), of noise 321, 323, 325, 327 and/or acoustical signal sources 311, 313, 315, 317. For example, these characteristics may include (without limitations) spectral, time and directivity characteristics, current SPLs, SPL limits, geo-coordinates, etc., where SPL is also referred to as acoustic pressure level that is a logarithmic measure of an effective pressure of a sound relative to a reference value.

As aforementioned, in one embodiment, the acoustical part of a footprint may be created and assigned during production or manufacturing of a device serving as acoustical signal source, such as ambulance 315, jackhammer 317, etc., where this process of creation and assignment of footprints may be performed at one of the final stages of device production. These footprints may be measured for accuracy by any one of device manufacturers, third-party entities (e.g., companies, laboratories, etc.), etc., prior to their assignment to the corresponding devices which may then serve as acoustical signal sources, such as ambulance 315, jackhammer 317, etc. Each footprint may be unique to its corresponding acoustical signal source 315, 317 or in some cases, within a range of multiple devices requirements and closer to a specific model. In one embodiment, a footprint may be stored at a storage medium/device of its corresponding device, such as acoustical signal sources 315, 317, if, for example, the device is regarded as capable of broadcasting the footprint. In another embodiment, footprints may be stored at database(s) 225.

In one embodiment, database(s) 225, also referred to as footprint database, may be organized and accessed in various manners, cloud-based, object-oriented, etc., capable of being accessed through one or more communication medium(s) 230, such as a cloud network, the Internet, etc. Further, in one embodiment, computing device 100 having acoustics mechanism 110 may serve as a context-aware acoustical signal cancellation and amplification system (CANCAS) device that can query database(s) 225 using footprint identifications (IDs) and receive as an output the corresponding footprint from database(s) 225. As described previously, footprints may also be stored at computing device 100 or individual acoustical signal source(s) 315, 317.

Further, for example, the geo-coordinates part of a footprint may be generated by its corresponding device service as an acoustical signal source, such as ambulance 315 and jackhammer 317, based on its position using a location-detection technique, such as Global Positioning System (GPS), etc. This location or geo-coordinates information is then added to the corresponding footprint, which then results in an acoustical signal source-specific footprint. Further, acoustical signal sources 315, 317 with footprints may transmit their footprints or footprint IDs along with emitting their respectively noises 325, 327. This generation of footprints or footprint IDs may be ultrasonic, while their directional properties and levels may be similar to the acoustical signal, such as noise 325, 327, being emitted by their respective devices, such as acoustical signal sources 315, 317.

Moreover, acoustical signal sources 315, 317 emitting noises 325, 327 with footprints (or footprint IDs) may simultaneously broadcast their noises 325, 327 and the footprints and/or footprint IDs through various side channels or communication medium(s) 230, such as the Internet, cellphone networks (3G, LTE, etc.). In one embodiment, evaluation, estimation, and footprint logic 203 of acoustics mechanism 110 may utilize footprints or IDs to identify acoustical signal presence in the vicinity of a location so that the voice may be attenuated or amplified depending on the information obtained through those footprint or footprint IDs. Further, in some embodiments, footprints are broadcasted by acoustical signal sources 315, 317 when computing device 100 is determined to be capable of discovering and receiving the broadcast as facilitated by acoustics mechanism 110.

In one embodiment, footprints may be broadcasted in air for facilitating communication between two or more receiving devices, such as a user's mobile device may communicate a relevant footprint to be received by other mobile devices using communication medium(s) 230, such as a side channel like the Internet. Further, in one embodiment, acoustics mechanism 110 may hide a geo-location in a footprint of noise 325, 327 while digitally mapping the surroundings to discover whether the acoustical signal from its corresponding acoustical signal source 315, 317 is potentially noticeable by acoustics mechanism 110 with respect to its host device, such as computing device 100.

As illustrated and discussed with reference to FIG. 2, computing device 100 having acoustics mechanism 110 serves as a context-aware acoustical signal cancellation and amplification system having microphones, loudspeakers, etc., in communication with digital signal processor (DSP) unit 303, which can allow for local analysis of acoustical signals through acoustics mechanism 110. Depending on the analysis and evaluation of noises 321, 323, 325, 327, as facilitated by evaluation, estimation, and footprint logic 203 of FIG. 2 of acoustics mechanism 110, noise 327 with footprint may be entirely cancelled, certain important acoustical signals of noises 321, 325 may be amplified, while noise 323 without footprint may be masked, or any combination thereof, as facilitated by acoustical signal cancellation logic 205 and/or acoustical signal amplification logic 207 of FIG. 2 of acoustics mechanism 110.

As described earlier, it is contemplated that although this system setup 300 involves a house/office environment with possibly loudspeakers generating noise cancellation signals, etc., embodiments are not limited as such and are capable of being used in a variety of environmental settings. For example, in some embodiments, noise cancellation headphones may be used, both indoors and outdoors, to achieve a final noise cancellation. For example, when considering the method of FIG. 4, the only difference in this case may be having the noise cancelling signal render through headphones as opposed to loudspeakers.

Figure 3B:
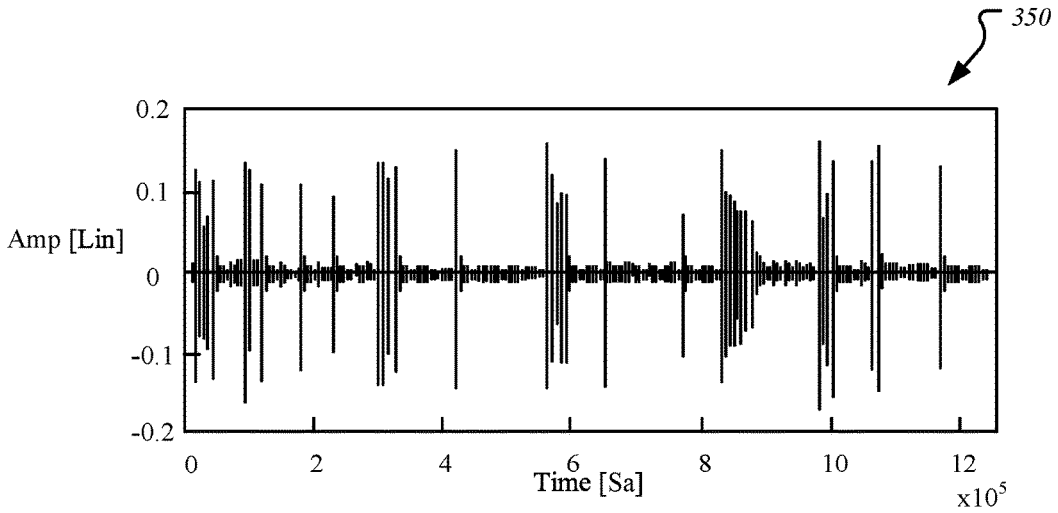
FIGS. 3B-3C illustrate graphs showing waveforms and sound pressure level readings relating to a dog bark according to one embodiment.
Figure 3C:
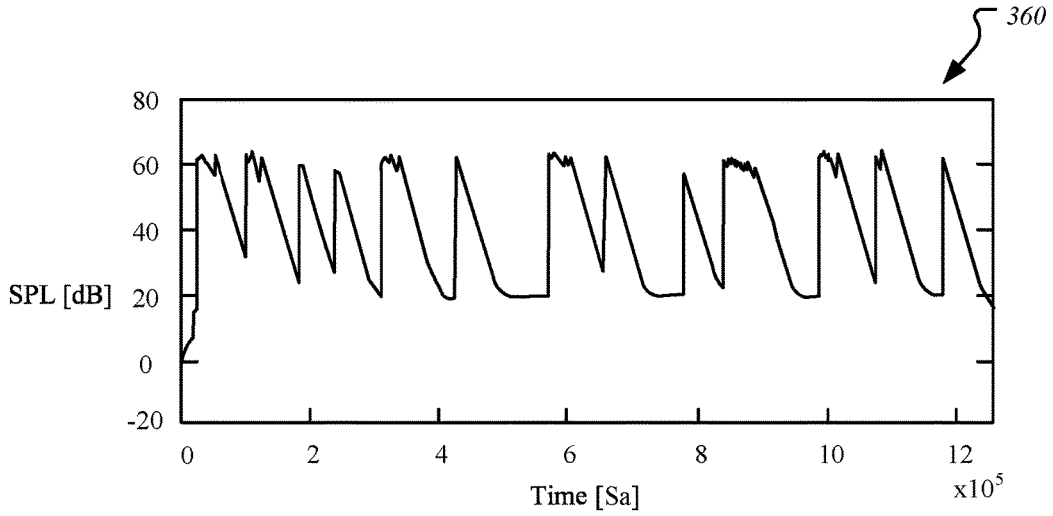

FIGS. 3B-3C illustrate graphs 350, 360 showing waveforms and SPL readings relating to a dog bark according to one embodiment. For brevity, many of the details previously discussed with reference to FIGS. 1-3A may not be discussed or repeated hereafter. Any processes or transactions associated with this illustration may be illustrated or recited in linear sequences for brevity and clarity in presentation; however, it is contemplated that any number of them can be performed in parallel, asynchronously, or in different orders.

As illustrated, graph 350 reflects the results in waveform of a distant dog bark being regarded as an annoying sound. This sound annoyance (SA) may be estimated by evaluation, estimation, and footprint logic 203 of FIG. 2 based on SPL readings shown in graph 360, while the SPL readings may also be measured by evaluation, estimation, and footprint logic 203 of FIG. 2, such as by using frequency weighting or weighing. It is contemplated that in one embodiment, SA is calculated after all footprints have already been detected and removed, such using the SA algorithm to compare any measured SPL readings against a human hearing threshold (HT) and if the sound is louder than the HT, then the SA may be calculated as facilitated by evaluation, estimation, and footprint logic 203. Here, different tactics may be applied, such as the SA may be estimated as SPL dynamic, where impulsive sounds may be exposed considerable dynamic as depicted in graphs 350, 360, such as distant dog bark waveform of graph 350 and its SPL readings changing from 20 dB to 60 dB in graph 360.

Figure 4:
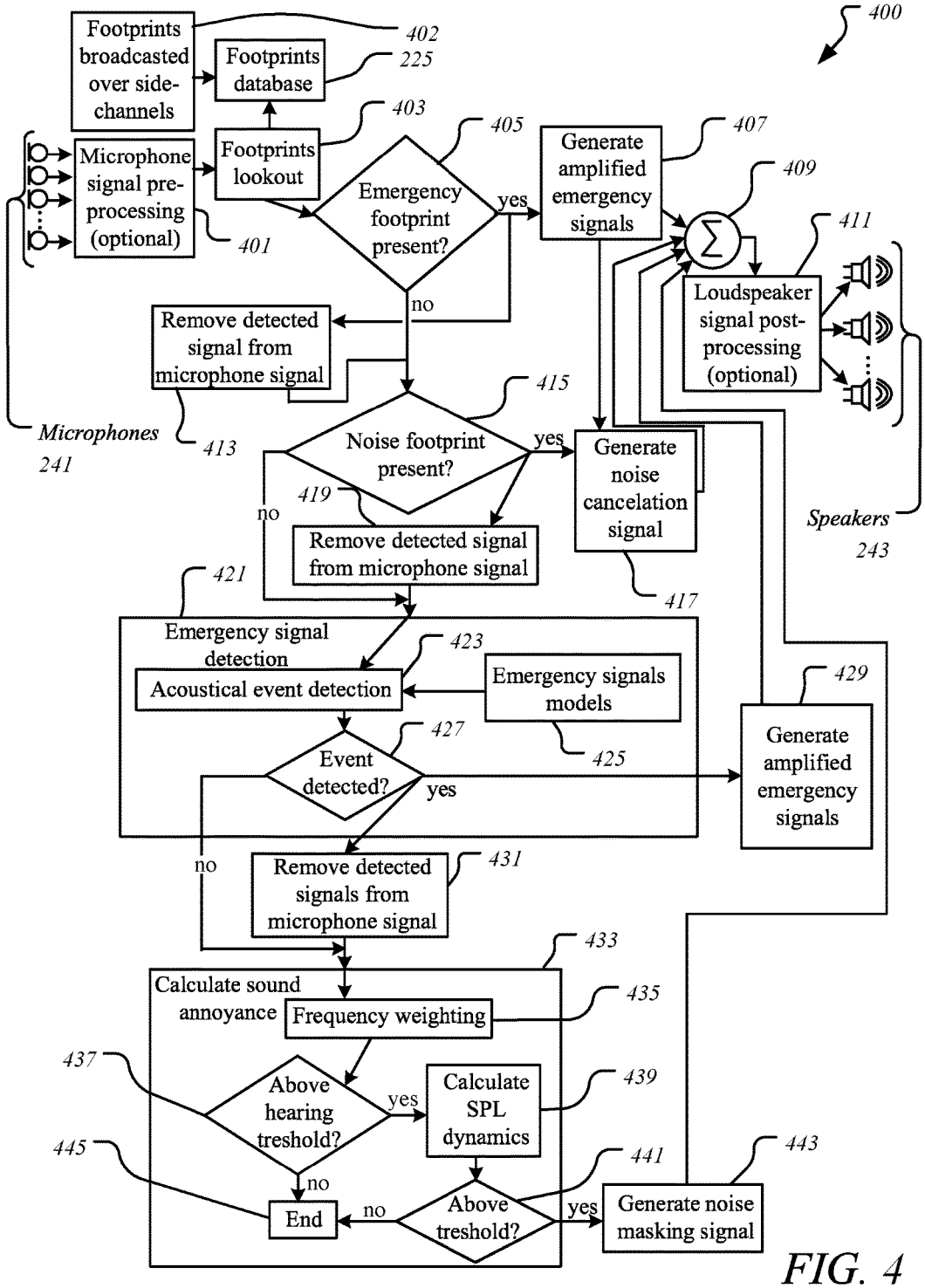
FIG. 4 illustrates a method for smart cancellation and amplification of acoustical signals according to one embodiment.

FIG. 4 illustrates a method 400 for smart cancellation and amplification of acoustical signals according to one embodiment. For brevity, many of the details previously discussed with reference to FIGS. 1-3C may not be discussed or repeated hereafter. Any processes or transactions may be performed by processing logic that may comprise hardware (e.g., circuitry, dedicated logic, programmable logic, etc.), software (such as instructions run on a processing device), or a combination thereof, as facilitated by acoustics mechanism 110 of FIG. 1. Any processes or transactions associated with this illustration may be illustrated or recited in linear sequences for brevity and clarity in presentation; however, it is contemplated that any number of them can be performed in parallel, asynchronously, or in different orders.

Method 400 begins with microphones 241 detecting an acoustical signal from an acoustical signal source, where the acoustical signal (e.g., noise) received by one or more of microphones 241 may be (optionally) pre-processed at block 401. In one embodiment, at block 403, this pre-processing may then lead to footprint lookout so determine whether the acoustical signal has any footprint (or footprint ID) associated with it, where this lookout may be performed by searching into or accessing database(s) 225 storing and maintaining footprints associated with various acoustical signals. In another embodiment, at 402, footprints may be broadcasted into database(s) 225 over one or more communication mediums or networks, such as a cloud network, the Internet, etc. In yet another embodiment, as described with reference to FIG. 2, footprints/footprint IDs may be assigned to or associated with acoustical signals in real-time as facilitated by evaluation, estimation, and footprint logic 203 of FIG. 2, where these footprints/footprint IDs may then be stored at one or more of database(s) 225.

Further, in one embodiment, once an acoustical signal is scanned for footprints at block 403, method 400 may allow for double-checking of the acoustical signal for footprints by checking to see whether database(s) 225 may include a footprint associated with or relevant to the acoustical signal. In one embodiment, database(s) 225 are populated by having footprints communicated from one or more of acoustical signal sources, manufacturers, operators, etc., to database(s) 225 over one or more networks (e.g., Internet). Further, each footprint at database(s) 225 may be classified as either an emergency footprint or a noisy footprint as facilitated by evaluation, estimation, and footprint logic 203 of FIG. 2.

In one embodiment, emergency footprints are further intensified using information provided through or associated with such footprints (such as emergency sirens, disaster alarms, crime alerts, etc.) so that the acoustical frequencies of these emergency footprints may be amplified, when needed, while maintaining their time sequence. Any discovered emergency signals may be substracted from the detected microphone/acoustical signals, such as based on spectral subtraction, so as not to interfere with their consecutive analysis. Similarly, noisy (but not emergency) signals with identified footprint or footprint IDs, such as noises coming from heavy construction devices (e.g., jackhammers, etc.), may be attenuated by generating low frequency acoustical signals and some anti-phase signals. In such cases, footprints typically provide the necessary information on spectral and time properties of the acoustical signal source. As with emergency signals, any discovered noisy signals are subtracted from the detected microphone signals using spectral subtraction so as not to interfere with their consecutive analysis.

As previously described, microphones 241, as facilitated by detection and recognition logic 201 of FIG. 2, may be used to continuously monitor various acoustical signals and their corresponding acoustical signal sources within their acoustical environment. For example, one or more of microphones 241 equipped with additional audio processing techniques, such as pre-processing techniques of block 401, may be used for the purposes of monitoring of acoustical signals and/or acoustical signal sources. Further, microphone arrays, such as microphones 241, using pre-processing techniques may be used to achieve a higher quality of processing of microphone signals that are better suited for subsequent analysis and evaluation by evaluation, estimation, and footprint logic 203 of FIG. 2.

Moreover, in one embodiment, microphones 241, as facilitated by detection and recognition logic 201 of FIG. 2, may be used to scan acoustical or audio signals to determine or recognize certain events, such as baby crying, glass breaking, etc., using one or more event detection techniques or components, such as Acoustical Event Detectors (ACAs). Further, as facilitated by detection and recognition logic 201 of FIG. 2, such event detection may be performed using certain classification algorithms, such as through deep learning models including deep learning neural networks (DNNs) using prior-trained or pre-trained classifiers that are understood and regarded as emergency signal models. Further, any acoustical signals classified by one or more event detection techniques or components, such as ACAs, may be subtracted from any detected microphone acoustical signals based on spectral subtraction so as not to interfere with their consecutive analysis.

As will be further described below with reference to FIG. 4, acoustical signals that are unidentified or do not include footprints or footprint IDs or remain unrecognized by ACAs, then evaluation, estimation, and footprint logic 203 of FIG. 2 may estimate the sound annoyance level associated with the detected acoustical signal. If, for example, the sound annoyance level of the acoustical signal is sufficiently high (such as potentially disturbing or harming the public as determined by comparing against known dB ratings and their consequences), then signal cancellation logic 205 of FIG. 2 may be triggered to mask the acoustical signal to limit the affects and perceptions of such acoustical signal.

Now referring back to method 400, in one embodiment, method 400 continues at block 405 where a determination is made as to whether there are any emergency footprints associated with the acoustical signal. If an emergency footprint is detected in the signal (such as in case of the ambulance signal from FIG. 3A, burglar alarm, etc.), the detected signal is removed from the microphone signal at block 413 and sent to block 407 for generation of amplified emergency signals that may be further carried to block 417 for generation of acoustical signal cancellation signal and then in either case, through block 409 onto (optional) post-processing of the signal at block 411 to then be broadcasted through one or more speakers 243, such as loudspeakers, room speakers, embedded computer or television speakers, radio speakers, wired or wireless headsets, and/or the like. If, however, no emergency footprints are detected, then, at block 415, another determination is made as to whether there is any acoustical signal footprint present in associated with the acoustical signal.

If the acoustical signal footprint is present at block 415, the detected signal is removed from the microphone signal at block 419 and sent to block 417 and generation of acoustical signal cancellation signal and then through block 409 onto (optional) post-processing of the signal at block 411 to then be broadcasted through one or more speakers 243. If, however, no acoustical signal footprints are found, then method 400 continues onto emergency signal detection at block 421.

At block 421, emergency detection of the acoustical signal is performed, including using acoustical event detection techniques/components, such as using ACAs, etc., at block 423, using and receiving feedback from deep learning-based emergency signal models at block 425, and/or the like, as facilitated by evaluation, estimation, and footprint logic 203 of FIG. 2. Then, using this acquired and/or estimated information, at block 427, a determination is made as to whether any events (such as baby crying from FIG. 3A) are detected. If an event is detected, then the signal is removed from the microphone signals at block 431 and method 400 continues onto block 429 with generation of amplified emergency signals and then, through block 409, the signal is sent onto block 411 for (optional) post-processing and broadcasting through one or more speakers 243.

If, however, events are not detected while the acoustical signal is not regarded as an emergency signal as determined at block 427, then method 400 continues with annoyance estimation at block 433 as facilitated by evaluation, estimation, and footprint logic 203 of FIG. 2. As illustrated, calculating sound annoyance refers to simply estimation the annoyance or nuisance level associated with an acoustical signal (such as the noise in case of dog barking of FIG. 3A) and may include performing processes like frequency weighting at block 435 to determine how frequently the acoustical signal is being relayed, such as every few seconds in case of dog barking, every few minutes of using firecrackers, etc.

At block 437, a determination is made as to whether the frequency determined from block 435 violates a pre-determined hearing threshold, HT. If the frequency is equal to or not weighed above the HT, the acoustical signal may be regarded as safe or tolerable to humans and allowed to go on and so method 400 ends at block 445. If, however, the frequency is weighed above HT, SPL dynamics may be calculated at block 439. In one embodiment, at block 441, another determination is made as to whether calculated SPL is above a predetermined SPL threshold. If the estimated SPL equal to or below the SPL threshold, the acoustical signal may be regarded as safe or tolerable to humans and allowed to go on and so method 400 ends at block 445. If, however, the SPL estimation is determined to be above the SPL threshold, the acoustical signal may be regarded as having annoyance or nuisance high enough that the acoustical signal may be masked at block 443. This masked acoustical signal may then be communicated on to block 409 and further on to block 411 for (optional) signal post-processing, where the masked noise may then be broadcasted through one or more speakers 243.

Figure 5:
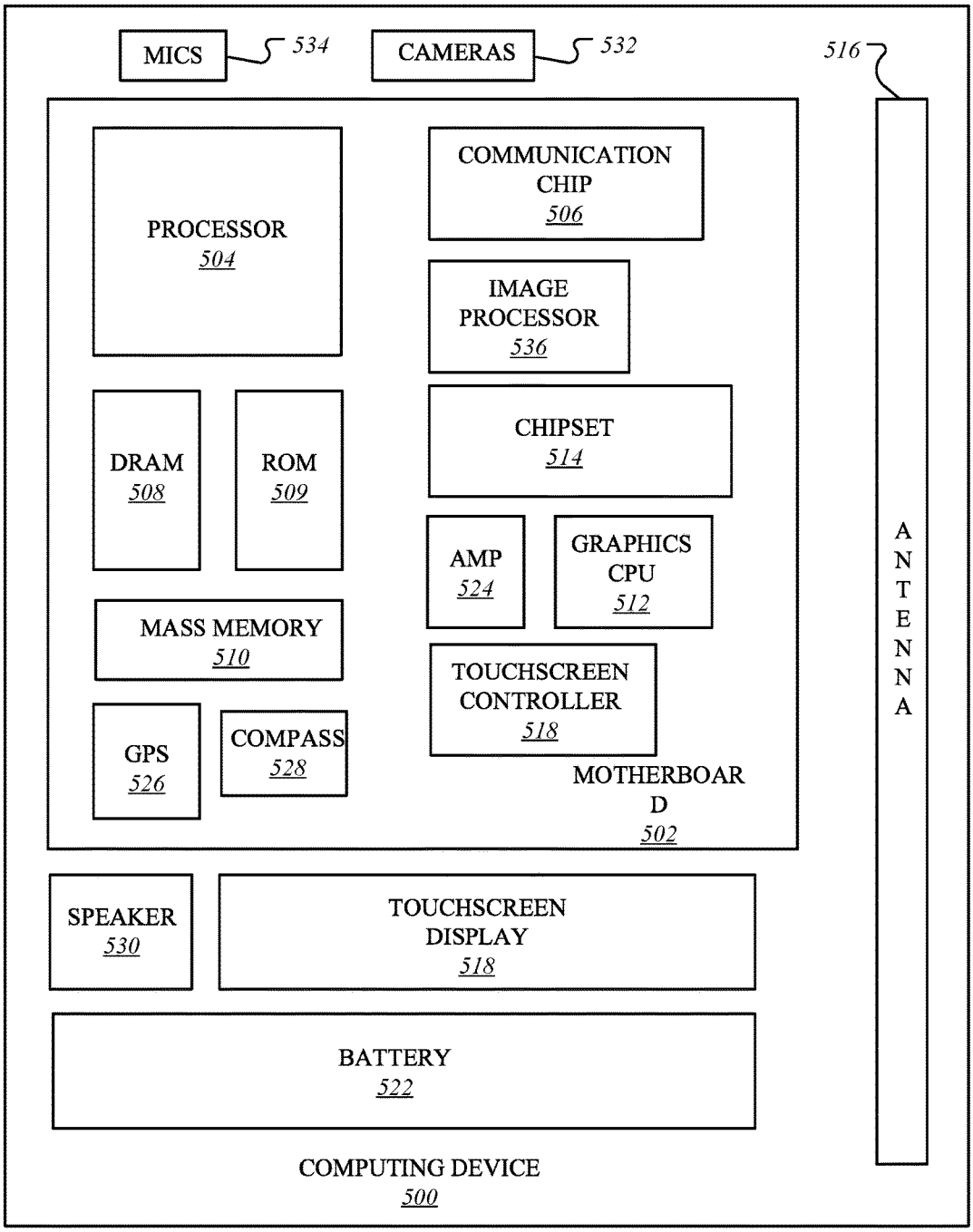
FIG. 5 illustrates a computer device capable of supporting and implementing one or more embodiments according to one embodiment.

FIG. 5 illustrates a computing device 500 in accordance with one implementation. The illustrated computing device 500 may be same as or similar to computing device 100 of FIG. 1. The computing device 500 houses a system board 502. The board 502 may include a number of components, including but not limited to a processor 504 and at least one communication package 506. The communication package is coupled to one or more antennas 516. The processor 504 is physically and electrically coupled to the board 502.

Depending on its applications, computing device 500 may include other components that may or may not be physically and electrically coupled to the board 502. These other components include, but are not limited to, volatile memory (e.g., DRAM) 508, non-volatile memory (e.g., ROM) 509, flash memory (not shown), a graphics processor 512, a digital signal processor (not shown), a crypto processor (not shown), a chipset 514, an antenna 516, a display 518 such as a touchscreen display, a touchscreen controller 520, a battery 522, an audio codec (not shown), a video codec (not shown), a power amplifier 524, a global positioning system (GPS) device 526, a compass 528, an accelerometer (not shown), a gyroscope (not shown), a speaker 530, cameras 532, a microphone array 534, and a mass storage device (such as hard disk drive) 510, compact disk (CD) (not shown), digital versatile disk (DVD) (not shown), and so forth). These components may be connected to the system board 502, mounted to the system board, or combined with any of the other components.

The communication package 506 enables wireless and/or wired communications for the transfer of data to and from the computing device 500. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication package 506 may implement any of a number of wireless or wired standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, Ethernet derivatives thereof, as well as any other wireless and wired protocols that are designated as 3G, 4G, 5G, and beyond. The computing device 500 may include a plurality of communication packages 506. For instance, a first communication package 506 may be dedicated to shorter range wireless communications such as Wi-Fi and Bluetooth and a second communication package 506 may be dedicated to longer range wireless communications such as GPS, EDGE, GPRS, CDMA, WiMAX, LTE, Ev-DO, and others.

The cameras 532 including any depth sensors or proximity sensor are coupled to an optional image processor 536 to perform conversions, analysis, noise reduction, comparisons, depth or distance analysis, image understanding, and other processes as described herein. The processor 504 is coupled to the image processor to drive the process with interrupts, set parameters, and control operations of image processor and the cameras. Image processing may instead be performed in the processor 504, the graphics CPU 512, the cameras 532, or in any other device.

In various implementations, the computing device 500 may be a laptop, a netbook, a notebook, an ultrabook, a smartphone, a tablet, a personal digital assistant (PDA), an ultra mobile PC, a mobile phone, a desktop computer, a server, a set-top box, an entertainment control unit, a digital camera, a portable music player, or a digital video recorder. The computing device may be fixed, portable, or wearable. In further implementations, the computing device 500 may be any other electronic device that processes data or records data for processing elsewhere.

Embodiments may be implemented using one or more memory chips, controllers, CPUs (Central Processing Unit), microchips or integrated circuits interconnected using a motherboard, an application specific integrated circuit (ASIC), and/or a field programmable gate array (FPGA). The term "logic" may include, by way of example, software or hardware and/or combinations of software and hardware.

References to "one embodiment", "an embodiment", "example embodiment", "various embodiments", etc., indicate that the embodiment(s) so described may include particular features, structures, or characteristics, but not every embodiment necessarily includes the particular features, structures, or characteristics. Further, some embodiments may have some, all, or none of the features described for other embodiments.

In the following description and claims, the term "coupled" along with its derivatives, may be used. "Coupled" is used to indicate that two or more elements co-operate or interact with each other, but they may or may not have intervening physical or electrical components between them.

As used in the claims, unless otherwise specified, the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

Embodiments may be provided, for example, as a computer program product which may include one or more transitory or non-transitory machine-readable storage media having stored thereon machine-executable instructions that, when executed by one or more machines such as a computer, network of computers, or other electronic devices, may result in the one or more machines carrying out operations in accordance with embodiments described herein. A machine-readable medium may include, but is not limited to, floppy diskettes, optical disks, CD-ROMs (Compact Disc-Read Only Memories), and magneto-optical disks, ROMs, RAMs, EPROMs (Erasable Programmable Read Only Memories), EEPROMs (Electrically Erasable Programmable Read Only Memories), magnetic or optical cards, flash memory, or other type of media/machine-readable medium suitable for storing machine-executable instructions.

Figure 6:
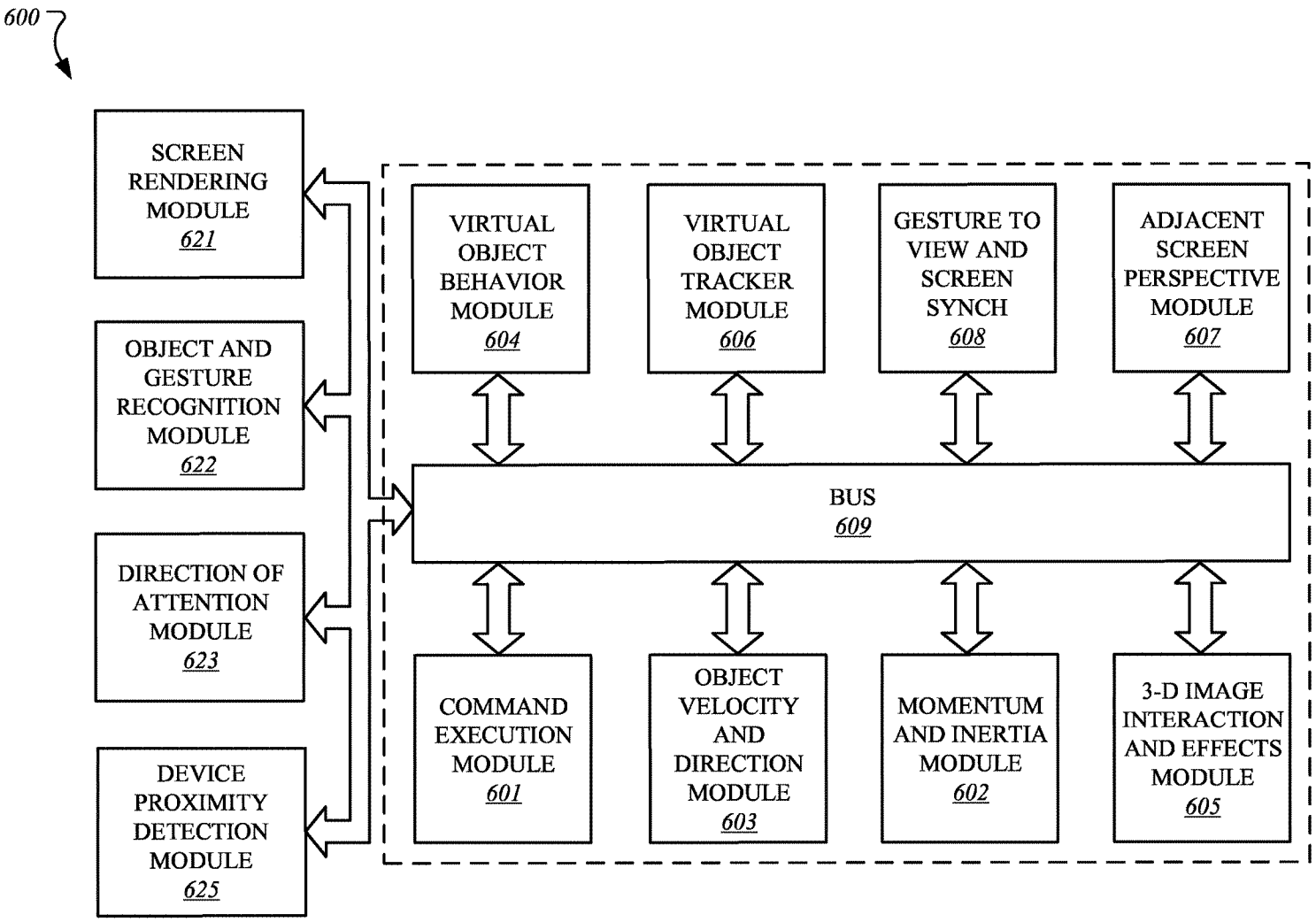
FIG. 6 illustrates an embodiment of a computing environment capable of supporting and implementing one or more embodiments according to one embodiment.

FIG. 6 illustrates an embodiment of a computing environment 600 capable of supporting the operations discussed above. The modules and systems can be implemented in a variety of different hardware architectures and form factors including that shown in FIG. 5.

The Command Execution Module 601 includes a central processing unit to cache and execute commands and to distribute tasks among the other modules and systems shown. It may include an instruction stack, a cache memory to store intermediate and final results, and mass memory to store applications and operating systems. The Command Execution Module may also serve as a central coordination and task allocation unit for the system.

The Screen Rendering Module 621 draws objects on the one or more multiple screens for the user to see. It can be adapted to receive the data from the Virtual Object Behavior Module 604, described below, and to render the virtual object and any other objects and forces on the appropriate screen or screens. Thus, the data from the Virtual Object Behavior Module would determine the position and dynamics of the virtual object and associated gestures, forces and objects, for example, and the Screen Rendering Module would depict the virtual object and associated objects and environment on a screen, accordingly. The Screen Rendering Module could further be adapted to receive data from the Adjacent Screen Perspective Module 607, described below, to either depict a target landing area for the virtual object if the virtual object could be moved to the display of the device with which the Adjacent Screen Perspective Module is associated. Thus, for example, if the virtual object is being moved from a main screen to an auxiliary screen, the Adjacent Screen Perspective Module 2 could send data to the Screen Rendering Module to suggest, for example in shadow form, one or more target landing areas for the virtual object on that track to a user's hand movements or eye movements.

The Object and Gesture Recognition Module 622 may be adapted to recognize and track hand and arm gestures of a user. Such a module may be used to recognize hands, fingers, finger gestures, hand movements and a location of hands relative to displays. For example, the Object and Gesture Recognition Module could for example determine that a user made a body part gesture to drop or throw a virtual object onto one or the other of the multiple screens, or that the user made a body part gesture to move the virtual object to a bezel of one or the other of the multiple screens. The Object and Gesture Recognition System may be coupled to a camera or camera array, a microphone or microphone array, a touch screen or touch surface, or a pointing device, or some combination of these items, to detect gestures and commands from the user.

The touch screen or touch surface of the Object and Gesture Recognition System may include a touch screen sensor. Data from the sensor may be fed to hardware, software, firmware or a combination of the same to map the touch gesture of a user's hand on the screen or surface to a corresponding dynamic behavior of a virtual object. The sensor date may be used to momentum and inertia factors to allow a variety of momentum behavior for a virtual object based on input from the user's hand, such as a swipe rate of a user's finger relative to the screen. Pinching gestures may be interpreted as a command to lift a virtual object from the display screen, or to begin generating a virtual binding associated with the virtual object or to zoom in or out on a display. Similar commands may be generated by the Object and Gesture Recognition System using one or more cameras without the benefit of a touch surface.

The Direction of Attention Module 623 may be equipped with cameras or other sensors to track the position or orientation of a user's face or hands. When a gesture or voice command is issued, the system can determine the appropriate screen for the gesture. In one example, a camera is mounted near each display to detect whether the user is facing that display. If so, then the direction of attention module information is provided to the Object and Gesture Recognition Module 622 to ensure that the gestures or commands are associated with the appropriate library for the active display. Similarly, if the user is looking away from all of the screens, then commands can be ignored.

The Device Proximity Detection Module 625 can use proximity sensors, compasses, GPS (global positioning system) receivers, personal area network radios, and other types of sensors, together with triangulation and other techniques to determine the proximity of other devices. Once a nearby device is detected, it can be registered to the system and its type can be determined as an input device or a display device or both. For an input device, received data may then be applied to the Object Gesture and Recognition Module 622. For a display device, it may be considered by the Adjacent Screen Perspective Module 607.

The Virtual Object Behavior Module 604 is adapted to receive input from the Object Velocity and Direction Module, and to apply such input to a virtual object being shown in the display. Thus, for example, the Object and Gesture Recognition System would interpret a user gesture and by mapping the captured movements of a user's hand to recognized movements, the Virtual Object Tracker Module would associate the virtual object's position and movements to the movements as recognized by Object and Gesture Recognition System, the Object and Velocity and Direction Module would capture the dynamics of the virtual object's movements, and the Virtual Object Behavior Module would receive the input from the Object and Velocity and Direction Module to generate data that would direct the movements of the virtual object to correspond to the input from the Object and Velocity and Direction Module.

The Virtual Object Tracker Module 606 on the other hand may be adapted to track where a virtual object should be located in three-dimensional space in a vicinity of a display, and which body part of the user is holding the virtual object, based on input from the Object and Gesture Recognition Module. The Virtual Object Tracker Module 606 may for example track a virtual object as it moves across and between screens and track which body part of the user is holding that virtual object. Tracking the body part that is holding the virtual object allows a continuous awareness of the body part's air movements, and thus an eventual awareness as to whether the virtual object has been released onto one or more screens.

The Gesture to View and Screen Synchronization Module 608, receives the selection of the view and screen or both from the Direction of Attention Module 623 and, in some cases, voice commands to determine which view is the active view and which screen is the active screen. It then causes the relevant gesture library to be loaded for the Object and Gesture Recognition Module 622. Various views of an application on one or more screens can be associated with alternative gesture libraries or a set of gesture templates for a given view. As an example, in FIG. 1A, a pinch-release gesture launches a torpedo, but in FIG. 1B, the same gesture launches a depth charge.

The Adjacent Screen Perspective Module 607, which may include or be coupled to the Device Proximity Detection Module 625, may be adapted to determine an angle and position of one display relative to another display. A projected display includes, for example, an image projected onto a wall or screen. The ability to detect a proximity of a nearby screen and a corresponding angle or orientation of a display projected therefrom may for example be accomplished with either an infrared emitter and receiver, or electromagnetic or photo-detection sensing capability. For technologies that allow projected displays with touch input, the incoming video can be analyzed to determine the position of a projected display and to correct for the distortion caused by displaying at an angle. An accelerometer, magnetometer, compass, or camera can be used to determine the angle at which a device is being held while infrared emitters and cameras could allow the orientation of the screen device to be determined in relation to the sensors on an adjacent device. The Adjacent Screen Perspective Module 607 may, in this way, determine coordinates of an adjacent screen relative to its own screen coordinates. Thus, the Adjacent Screen Perspective Module may determine which devices are in proximity to each other, and further potential targets for moving one or more virtual objects across screens. The Adjacent Screen Perspective Module may further allow the position of the screens to be correlated to a model of three-dimensional space representing all of the existing objects and virtual objects.

The Object and Velocity and Direction Module 603 may be adapted to estimate the dynamics of a virtual object being moved, such as its trajectory, velocity (whether linear or angular), momentum (whether linear or angular), etc. by receiving input from the Virtual Object Tracker Module. The Object and Velocity and Direction Module may further be adapted to estimate dynamics of any physics forces, by for example estimating the acceleration, deflection, degree of stretching of a virtual binding, etc. and the dynamic behavior of a virtual object once released by a user's body part. The Object and Velocity and Direction Module may also use image motion, size and angle changes to estimate the velocity of objects, such as the velocity of hands and fingers The Momentum and Inertia Module 602 can use image motion, image size, and angle changes of objects in the image plane or in a three-dimensional space to estimate the velocity and direction of objects in the space or on a display. The Momentum and Inertia Module is coupled to the Object and Gesture Recognition Module 622 to estimate the velocity of gestures performed by hands, fingers, and other body parts and then to apply those estimates to determine momentum and velocities to virtual objects that are to be affected by the gesture.

The 3D Image Interaction and Effects Module 605 tracks user interaction with 3D images that appear to extend out of one or more screens. The influence of objects in the z-axis (towards and away from the plane of the screen) can be calculated together with the relative influence of these objects upon each other. For example, an object thrown by a user gesture can be influenced by 3D objects in the foreground before the virtual object arrives at the plane of the screen. These objects may change the direction or velocity of the projectile or destroy it entirely. The object can be rendered by the 3D Image Interaction and Effects Module in the foreground on one or more of the displays. As illustrated, various components, such as components 601, 602, 603, 604, 605. 606, 607, and 608 are connected via an interconnect or a bus, such as bus 609.

The following clauses and/or examples pertain to further embodiments or examples. Specifics in the examples may be used anywhere in one or more embodiments. The various features of the different embodiments or examples may be variously combined with some features included and others excluded to suit a variety of different applications. Examples may include subject matter such as a method, means for performing acts of the method, at least one machine-readable medium including instructions that, when performed by a machine cause the machine to perform acts of the method, or of an apparatus or system for facilitating hybrid communication according to embodiments and examples described herein.

Some embodiments pertain to Example 1 that includes an apparatus to facilitate context-based cancellation and amplification of acoustical signals in acoustical environments, the apparatus comprising: detection and recognition logic to detect an acoustical signal being emitted by an acoustical signal source; evaluation, estimation, and footprint logic to classify the acoustical signal as an emergency acoustical signal or a non-emergency acoustical signal, wherein the classification is based on a footprint or a footprint identification (ID) associated with the acoustical signal; acoustical signal cancellation logic to cancel the acoustical signal if the acoustical signal is regarded as the non-emergency acoustical signal based on the footprint or the footprint ID; and acoustical signal amplification logic to amplify the acoustical signal if the acoustical signal is classified as the emergency acoustical signal based on the footprint or the footprint ID.

Example 2 includes the subject matter of Example 1, wherein the footprint includes description relating to the acoustical signal, wherein the footprint ID includes one or more of a number, an alphabet, or a character mapped to the description, wherein the footprint, footprint ID, and the description are stored at one or more databases.

Example 3 includes the subject matter of Examples 1-2, wherein the footprint or the footprint ID is associated with the acoustical signal during manufacturing of the acoustical signal source, wherein the evaluation, estimation, and footprint logic is further to assign the footprint or the footprint ID to the acoustical signal in real-time.

Example 4 includes the subject matter of Examples 1-3, wherein the evaluation, estimation, and footprint logic to evaluate the acoustical signal for detecting an emergency signal associated with the acoustical signal if the acoustical signal is not assigned the footprint or the footprint ID, wherein the acoustical signal is regarded as the emergency acoustical signal if the emergency signal is found to be associated with the acoustical signal, and wherein the acoustical signal application logic to amplify the acoustical signal classified as the emergency acoustical signal based on the emergency signal, and wherein the acoustical signal cancellation logic to cancel or mask the acoustical signal classified as the non-emergency acoustical signal based on the emergency signal.

Example 5 includes the subject matter of Examples 1-4, wherein the evaluation, estimation, and footprint logic to estimate annoyance level associated with the acoustical signal, if the acoustical signal lacks the footprint, the footprint ID, and the emergency signal, wherein the annoyance level is compared to at least one of a hearing threshold and sound pressure levels (SPLs) to determine whether acoustical signal is regarded as tolerable or intolerable to humans, wherein the annoyance level is estimated as SPL dynamics change over time, and wherein the acoustical signal cancellation logic to cancel or mask the acoustical signal if the acoustical signal is regarded as intolerable based on the annoyance level.

Example 6 includes the subject matter of Examples 1-5, further comprising communication/compatibility logic to issue one or more of requests, complaints, and warnings to one or more of acoustical signal sources, operators of the acoustical signal sources, and government officials, wherein the acoustical signal sources include one or more of humans, animals, devices, tools, equipment, vehicles, and nature.

Example 7 includes the subject matter of Examples 1-6, wherein the apparatus comprises one or more processors including a graphics processor co-located with an application processor on a common semiconductor package.

Some embodiments pertain to Example 8 that includes a method facilitating context-based cancellation and amplification of acoustical signals in acoustical environments, the method comprising: detecting, by a microphone of a computing device, an acoustical signal being emitted by an acoustical signal source; classifying the acoustical signal as an emergency acoustical signal or a non-emergency acoustical signal, wherein the classification is based on a footprint or a footprint identification (ID) associated with the acoustical signal; cancelling the acoustical signal if the acoustical signal is regarded as the non-emergency acoustical signal based on the footprint or the footprint ID; and amplifying the acoustical signal if the acoustical signal is classified as the emergency acoustical signal based on the footprint or the footprint ID.

Example 9 includes the subject matter of Example 8, wherein the footprint includes description relating to the acoustical signal, wherein the footprint ID includes one or more of a number, an alphabet, or a character mapped to the description, wherein the footprint, footprint ID, and the description are stored at one or more databases.

Example 10 includes the subject matter of Examples 8-9, wherein the footprint or the footprint ID is associated with the acoustical signal during manufacturing of the acoustical signal source, wherein the footprint or the footprint ID are assigned to the acoustical signal in real-time.

Example 11 includes the subject matter of Examples 8-10, further comprising: evaluating the acoustical signal for detecting an emergency signal associated with the acoustical signal if the acoustical signal is not assigned the footprint or the footprint ID, wherein the acoustical signal is regarded as the emergency acoustical signal if the emergency signal is found to be associated with the acoustical signal; amplifying the acoustical signal classified as the emergency acoustical signal based on the emergency signal; and cancelling or masking the acoustical signal classified as the non-emergency acoustical signal based on the emergency signal.

Example 12 includes the subject matter of Examples 8-11, further comprising: estimating annoyance level associated with the acoustical signal, if the acoustical signal lacks the footprint, the footprint ID, and the emergency signal, wherein the annoyance level is compared to at least one of a hearing threshold and sound pressure levels (SPLs) to determine whether acoustical signal is regarded as tolerable or intolerable to humans, wherein the annoyance level is estimated as SPL dynamics change over time; and cancelling or masking the acoustical signal if the acoustical signal is regarded as intolerable based on the annoyance level.

Example 13 includes the subject matter of Examples 8-12, further comprising issuing one or more of requests, complaints, and warnings to one or more of acoustical signal sources, operators of the acoustical signal sources, and government officials, wherein the acoustical signal sources include one or more of humans, animals, devices, tools, equipment, vehicles, and nature.

Example 14 includes the subject matter of Examples 8-13, wherein the computing device comprises one or more processors including a graphics processor co-located with an application processor on a common semiconductor package.

Some embodiments pertain to Example 15 that includes a data processing system comprising a computing system having a memory device coupled to a processing device, the processing device to: detect, via a microphone, an acoustical signal being emitted by an acoustical signal source; classify the acoustical signal as an emergency acoustical signal or a non-emergency acoustical signal, wherein the classification is based on a footprint or a footprint identification (ID) associated with the acoustical signal; cancel the acoustical signal if the acoustical signal is regarded as the non-emergency acoustical signal based on the footprint or the footprint ID; and amplify the acoustical signal if the acoustical signal is classified as the emergency acoustical signal based on the footprint or the footprint ID.

Example 16 includes the subject matter of Example 15, wherein the footprint includes description relating to the acoustical signal, wherein the footprint ID includes one or more of a number, an alphabet, or a character mapped to the description, wherein the footprint, footprint ID, and the description are stored at one or more databases.

Example 17 includes the subject matter of Examples 15-16, wherein the footprint or the footprint ID is associated with the acoustical signal during manufacturing of the acoustical signal source, wherein the footprint or the footprint ID are assigned to the acoustical signal in real-time.

Example 18 includes the subject matter of Examples 15-17, wherein the processing device is further to: evaluate the acoustical signal for detecting an emergency signal associated with the acoustical signal if the acoustical signal is not assigned the footprint or the footprint ID, wherein the acoustical signal is regarded as the emergency acoustical signal if the emergency signal is found to be associated with the acoustical signal; amplify the acoustical signal classified as the emergency acoustical signal based on the emergency signal; and cancel or mask the acoustical signal classified as the non-emergency acoustical signal based on the emergency signal.

Example 19 includes the subject matter of Examples 15-17, wherein the processing device is further to: estimate annoyance level associated with the acoustical signal, if the acoustical signal lacks the footprint, the footprint ID, and the emergency signal, wherein the annoyance level is compared to at least one of a hearing threshold and sound pressure levels (SPLs) to determine whether acoustical signal is regarded as tolerable or intolerable to humans, wherein the annoyance level is estimated as SPL dynamics change over time; and cancel or mask the acoustical signal if the acoustical signal is regarded as intolerable based on the annoyance level.

Example 20 includes the subject matter of Examples 15-19, wherein the processing device is further to issue one or more of requests, complaints, and warnings to one or more of acoustical signal sources, operators of the acoustical signal sources, and government officials, wherein the acoustical signal sources include one or more of humans, animals, devices, tools, equipment, vehicles, and nature.

Example 21 includes the subject matter of Examples 15-20, wherein the processing device comprises a graphics processor co-located with an application processor on a common semiconductor package.

Some embodiments pertain to Example 22 that includes an apparatus to facilitate context-based cancellation and amplification of acoustical signals in acoustical environments, the apparatus comprising: means for detecting, via a microphone, an acoustical signal being emitted by an acoustical signal source; means for classifying the acoustical signal as an emergency acoustical signal or a non-emergency acoustical signal, wherein the classification is based on a footprint or a footprint identification (ID) associated with the acoustical signal; means for cancelling the acoustical signal if the acoustical signal is regarded as the non-emergency acoustical signal based on the footprint or the footprint ID; and means for amplifying the acoustical signal if the acoustical signal is classified as the emergency acoustical signal based on the footprint or the footprint ID.

Example 23 includes the subject matter of Example 22, wherein the footprint includes description relating to the acoustical signal, wherein the footprint ID includes one or more of a number, an alphabet, or a character mapped to the description, wherein the footprint, footprint ID, and the description are stored at one or more databases.

Example 24 includes the subject matter of Examples 22-23, wherein the footprint or the footprint ID is associated with the acoustical signal during manufacturing of the acoustical signal source, wherein the footprint or the footprint ID are assigned to the acoustical signal in real-time.

Example 25 includes the subject matter of Examples 22-24, further comprising: means for evaluating the acoustical signal for detecting an emergency signal associated with the acoustical signal if the acoustical signal is not assigned the footprint or the footprint ID, wherein the acoustical signal is regarded as the emergency acoustical signal if the emergency signal is found to be associated with the acoustical signal; means for amplifying the acoustical signal classified as the emergency acoustical signal based on the emergency signal; and means for cancelling or means for masking the acoustical signal classified as the non-emergency acoustical signal based on the emergency signal.

Example 26 includes the subject matter of Examples 22-25, further comprising: means for estimating annoyance level associated with the acoustical signal, if the acoustical signal lacks the footprint, the footprint ID, and the emergency signal, wherein the annoyance level is compared to at least one of a hearing threshold and sound pressure levels (SPLs) to determine whether acoustical signal is regarded as tolerable or intolerable to humans, wherein the annoyance level is estimated as SPL dynamics change over time; and means for cancelling or masking the acoustical signal if the acoustical signal is regarded as intolerable based on the annoyance level.

Example 27 includes the subject matter of Examples 22-26, further comprising means for issuing one or more of requests, complaints, and warnings to one or more of acoustical signal sources, operators of the acoustical signal sources, and government officials, wherein the acoustical signal sources include one or more of humans, animals, devices, tools, equipment, vehicles, and nature.

Example 28 includes the subject matter of Examples 22-27, wherein the apparatus comprises one or more processors including a graphics processor co-located with an application processor on a common semiconductor package.

Example 29 includes at least one non-transitory or tangible machine-readable medium comprising a plurality of instructions, when executed on a computing device, to implement or perform a method as claimed in any of claims or examples 8-14.

Example 30 includes at least one machine-readable medium comprising a plurality of instructions, when executed on a computing device, to implement or perform a method as claimed in any of claims or examples 8-14.

Example 31 includes a system comprising a mechanism to implement or perform a method as claimed in any of claims or examples 8-14.

Example 32 includes an apparatus comprising means for performing a method as claimed in any of claims or examples 8-14.

Example 33 includes a computing device arranged to implement or perform a method as claimed in any of claims or examples 8-14.

Example 34 includes a communications device arranged to implement or perform a method as claimed in any of claims or examples 8-14.

Example 35 includes at least one machine-readable medium comprising a plurality of instructions, when executed on a computing device, to implement or perform a method or realize an apparatus as claimed in any preceding claims.

Example 36 includes at least one non-transitory or tangible machine-readable medium comprising a plurality of instructions, when executed on a computing device, to implement or perform a method or realize an apparatus as claimed in any preceding claims.

Example 37 includes a system comprising a mechanism to implement or perform a method or realize an apparatus as claimed in any preceding claims.

Example 38 includes an apparatus comprising means to perform a method as claimed in any preceding claims.

Example 39 includes a computing device arranged to implement or perform a method or realize an apparatus as claimed in any preceding claims.

Example 40 includes a communications device arranged to implement or perform a method or realize an apparatus as claimed in any preceding claims.

The drawings and the forgoing description give examples of embodiments. Those skilled in the art will appreciate that one or more of the described elements may well be combined into a single functional element. Alternatively, certain elements may be split into multiple functional elements.

Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

What is claimed is:

1. An apparatus comprising:

one or more processors to:

detect an acoustical signal being emitted by an acoustical signal source;

classify the acoustical signal as an emergency acoustical signal or a non-emergency acoustical signal, wherein the classification is based on a footprint or a footprint identification (ID) associated with the acoustical signal;

cancel the acoustical signal if the acoustical signal is regarded as the non-emergency acoustical signal based on the footprint or the footprint ID; and amplify the acoustical signal if the acoustical signal is classified as the emergency acoustical signal based on the footprint or the footprint ID.

2. The apparatus of claim 1, wherein the footprint includes description relating to the acoustical signal, wherein the footprint ID includes one or more of a number, an alphabet, or a character mapped to the description, wherein the footprint, footprint ID, and the description are stored at one or more databases.

3. The apparatus of claim 2, wherein the footprint or the footprint ID is associated with the acoustical signal during manufacturing of the acoustical signal source, wherein the evaluation, estimation, and footprint logic is further to assign the footprint or the footprint ID to the acoustical signal in real-time.

4. The apparatus of claim 1, wherein the one or more processors are further to:

evaluate the acoustical signal for detecting an emergency signal associated with the acoustical signal if the acoustical signal is not assigned the footprint or the footprint ID, wherein the acoustical signal is regarded as the emergency acoustical signal if the emergency signal is found to be associated with the acoustical signal;

amplify the acoustical signal classified as the emergency acoustical signal based on the emergency signal; and cancel or mask the acoustical signal classified as the non-emergency acoustical signal based on the emergency signal.

5. The apparatus of claim 1, wherein the one or more processors are further to:

estimate annoyance level associated with the acoustical signal, if the acoustical signal lacks the footprint, the footprint ID, and the emergency signal, wherein the annoyance level is compared to at least one of a hearing threshold and sound pressure levels (SPLs) to determine whether acoustical signal is regarded as tolerable or intolerable to humans, wherein the annoyance level is estimated as SPL dynamics change over time; and cancel or mask the acoustical signal if the acoustical signal is regarded as intolerable based on the annoyance level.

6. The apparatus of claim 1, wherein the one or more processors are further to issue one or more of requests, complaints, and warnings to one or more of acoustical signal sources, operators of the acoustical signal sources, and government officials, wherein the acoustical signal sources include one or more of humans, animals, devices, tools, equipment, vehicles, and nature.

7. The apparatus of claim 1, wherein the one or more processors comprise one or more of a graphics processor and an application processor, wherein the graphics and applications processors are co-located on a common semiconductor package.

8. A method comprising:

detecting, by one or more processors of a computing device, an acoustical signal being emitted by an acoustical signal source, wherein the one or more processors to facilitate a microphone to detect the acoustical signal;

classifying, by the one or more processors, the acoustical signal as an emergency acoustical signal or a non-emergency acoustical signal, wherein the classification is based on a footprint or a footprint identification (ID) associated with the acoustical signal;

cancelling, by the one or more processors, the acoustical signal if the acoustical signal is regarded as the non-emergency acoustical signal based on the footprint or the footprint ID; and amplifying, by the one or more processors, the acoustical signal if the acoustical signal is classified as the emergency acoustical signal based on the footprint or the footprint ID.

9. The method of claim 8, wherein the footprint includes description relating to the acoustical signal, wherein the footprint ID includes one or more of a number, an alphabet, or a character mapped to the description, wherein the footprint, footprint ID, and the description are stored at one or more databases.

10. The method of claim 9, wherein the footprint or the footprint ID is associated with the acoustical signal during manufacturing of the acoustical signal source, wherein the footprint or the footprint ID are assigned to the acoustical signal in real-time.

11. The method of claim 8, further comprising:

evaluating, by the one or more processors, the acoustical signal for detecting an emergency signal associated with the acoustical signal if the acoustical signal is not assigned the footprint or the footprint ID, wherein the acoustical signal is regarded as the emergency acoustical signal if the emergency signal is found to be associated with the acoustical signal;

amplifying, by the one or more processors, the acoustical signal classified as the emergency acoustical signal based on the emergency signal; and cancelling or masking, by the one or more processors, the acoustical signal classified as the non-emergency acoustical signal based on the emergency signal.

12. The method of claim 8, further comprising:

estimating, by the one or more processors, annoyance level associated with the acoustical signal, if the acoustical signal lacks the footprint, the footprint ID, and the emergency signal, wherein the annoyance level is compared to at least one of a hearing threshold and sound pressure levels (SPLs) to determine whether acoustical signal is regarded as tolerable or intolerable to humans, wherein the annoyance level is estimated as SPL dynamics change over time; and cancelling or masking, by the one or more processors, the acoustical signal if the acoustical signal is regarded as intolerable based on the annoyance level.

13. The method of claim 8, further comprising issuing, by the one or more processors, one or more of requests, complaints, and warnings to one or more of acoustical signal sources, operators of the acoustical signal sources, and government officials, wherein the acoustical signal sources include one or more of humans, animals, devices, tools, equipment, vehicles, and nature.

14. The method of claim 8, wherein the computing device comprises one or more processors including a graphics processor co-located with an application processor on a common semiconductor package.

15. At least one non-transitory machine-readable medium comprising instructions which, when executed by a computing device, cause the computing device to perform operations comprising:

detecting, by a microphone, an acoustical signal being emitted by an acoustical signal source;

classifying the acoustical signal as an emergency acoustical signal or a non-emergency acoustical signal, wherein the classification is based on a footprint or a footprint identification (ID) associated with the acoustical signal;

cancelling the acoustical signal if the acoustical signal is regarded as the non-emergency acoustical signal based on the footprint or the footprint ID; and amplifying the acoustical signal if the acoustical signal is classified as the emergency acoustical signal based on the footprint or the footprint ID.

16. The non-transitory machine-readable medium of claim 15, wherein the footprint includes description relating to the acoustical signal, wherein the footprint ID includes one or more of a number, an alphabet, or a character mapped to the description, wherein the footprint, footprint ID, and the description are stored at one or more databases.

17. The non-transitory machine-readable medium of claim 16, wherein the footprint or the footprint ID is associated with the acoustical signal during manufacturing of the acoustical signal source, wherein the footprint or the footprint ID are assigned to the acoustical signal in real-time.

18. The non-transitory machine-readable medium of claim 15, wherein the operations comprise:

evaluating the acoustical signal for detecting an emergency signal associated with the acoustical signal if the acoustical signal is not assigned the footprint or the footprint ID, wherein the acoustical signal is regarded as the emergency acoustical signal if the emergency signal is found to be associated with the acoustical signal;

amplifying the acoustical signal classified as the emergency acoustical signal based on the emergency signal; and cancelling or masking the acoustical signal classified as the non-emergency acoustical signal based on the emergency signal.

19. The non-transitory machine-readable medium of claim 15, wherein the operations comprise:

estimating annoyance level associated with the acoustical signal, if the acoustical signal lacks the footprint, the footprint ID, and the emergency signal, wherein the annoyance level is compared to at least one of a hearing threshold and sound pressure levels (SPLs) to determine whether acoustical signal is regarded as tolerable or intolerable to humans, wherein the annoyance level is estimated as SPL dynamics change over time; and cancelling or masking the acoustical signal if the acoustical signal is regarded as intolerable based on the annoyance level.

20. The non-transitory machine-readable medium of claim 15, wherein the operations comprise issuing one or more of requests, complaints, and warnings to one or more of acoustical signal sources, operators of the acoustical signal sources, and government officials, wherein the acoustical signal sources include one or more of humans, animals, devices, tools, equipment, vehicles, and nature, wherein the computing device comprises one or more processors including a graphics processor co-located with an application processor on a common semiconductor package.

* * * * *